US011838720B2

(12) United States Patent
Su et al.

(10) Patent No.: US 11,838,720 B2
(45) Date of Patent: Dec. 5, 2023

(54) VIBRATION AND SOUND-MAKING APPARATUS AND ELECTRONIC DEVICE

(71) Applicant: Huawei Technologies Co., Ltd., Shenzhen (CN)

(72) Inventors: Jie Su, Shenzhen (CN); Tong Zhu, Shanghai (CN); Ligang Yu, Shenzhen (CN); Chunjian Li, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 151 days.

(21) Appl. No.: 17/440,521

(22) PCT Filed: Feb. 24, 2020

(86) PCT No.: PCT/CN2020/076423
§ 371 (c)(1),
(2) Date: Sep. 17, 2021

(87) PCT Pub. No.: WO2020/186971
PCT Pub. Date: Sep. 24, 2020

(65) Prior Publication Data

US 2022/0159369 A1 May 19, 2022

(30) Foreign Application Priority Data

Mar. 19, 2019 (CN) ..... 201910210343.3

(51) Int. Cl.
*H04R 1/24* (2006.01)
*H04R 3/14* (2006.01)
(Continued)

(52) U.S. Cl.
CPC ..... *H04R 1/24* (2013.01); *H04R 3/14* (2013.01); *H04R 5/02* (2013.01); *H04R 1/023* (2013.01);
(Continued)

(58) Field of Classification Search
CPC ... H04R 1/24; H04R 3/14; H04R 5/02; H04R 1/023; H04R 2205/022; H04R 2499/11;
(Continued)

(56) References Cited

U.S. PATENT DOCUMENTS 10,015,574 B1 * 7/2018 Luce ..... H04R 1/04
10,678,298 B2 * 6/2020 Mou ..... H04R 1/025
(Continued)

FOREIGN PATENT DOCUMENTS

CN 1197363 A 10/1998
CN 1755438 A 4/2006
(Continued)

*Primary Examiner* — Oyesola C Ojo
(74) *Attorney, Agent, or Firm* — Conley Rose, P.C.

(57) ABSTRACT

An electronic device includes a main body, a display disposed on the main body, and a sound-making assembly. The sound-making assembly includes a speaker box and a driving diaphragm located in the speaker box, the speaker box is disposed inside the main body or is formed using the main body and the display, where the main body includes a speaker grille corresponding to the speaker box, the driving diaphragm is fastened inside the speaker box and divides the speaker box into two sub-chambers, the speaker grille is coupled to one of the two sub-chambers, the driving diaphragm vibrates after receiving an audio signal, the driving diaphragm drives, through vibration of the driving diaphragm, air in the two sub-chambers to vibrate to make a sound, and the sound is propagated through the speaker grille.

20 Claims, 11 Drawing Sheets

(51) Int. Cl.
*H04R 5/02* (2006.01)
*H04R 1/02* (2006.01)

(52) U.S. Cl.
CPC .... *H04R 2205/022* (2013.01); *H04R 2499/11* (2013.01)

(58) Field of Classification Search
CPC ... H04R 3/04; H04R 3/12; H04R 7/18; H04R 7/04; H04R 17/00; H04R 9/02; H04R 9/06; H04R 2400/11
See application file for complete search history.

(56) References Cited

U.S. PATENT DOCUMENTS

| | | | | |
|---|---|---|---|---|
| 11,334,032 | B2 * | 5/2022 | Liang | G04G 17/08 |
| 2004/0052387 | A1 | 3/2004 | Norris et al. | |
| 2005/0221867 | A1 | 10/2005 | Zurek et al. | |
| 2006/0051075 | A1 | 3/2006 | Wada | |
| 2014/0301596 | A1 | 10/2014 | Wang et al. | |
| 2015/0030188 | A1 | 1/2015 | Nabata et al. | |
| 2015/0078604 | A1 | 3/2015 | Seo et al. | |
| 2016/0157370 | A1 | 6/2016 | Kanemaki et al. | |
| 2016/0234585 | A1 | 8/2016 | Filson et al. | |
| 2016/0269832 | A1 | 9/2016 | Nakamura et al. | |
| 2016/0353186 | A1 * | 12/2016 | Rothkopf | G04G 21/02 |
| 2017/0134857 | A1 | 5/2017 | Zurek et al. | |
| 2018/0084324 | A1 * | 3/2018 | Vitt | H04R 9/025 |
| 2019/0037165 | A1 | 1/2019 | Lee et al. | |
| 2019/0227591 | A1 * | 7/2019 | Youn | H04R 1/025 |
| 2020/0177980 | A1 | 6/2020 | Shin et al. | |
| 2020/0204924 | A1 * | 6/2020 | Kim | H04R 17/00 |
| 2020/0209973 | A1 * | 7/2020 | Kim | H04R 17/00 |
| 2020/0252707 | A1 * | 8/2020 | Won | H04R 9/025 |
| 2020/0267248 | A1 * | 8/2020 | Park | H04M 1/035 |
| 2021/0314429 | A1 * | 10/2021 | Huang | G06F 1/1632 |
| 2021/0352413 | A1 * | 11/2021 | Gebhart | H04R 17/10 |

FOREIGN PATENT DOCUMENTS

| | | | |
|---|---|---|---|
| CN | 201623850 | U | 11/2010 |
| CN | 201674661 | U | 12/2010 |
| CN | 102111702 | A | 6/2011 |
| CN | 102821344 | A | 12/2012 |
| CN | 202841517 | U | 3/2013 |
| CN | 203206465 | U | 9/2013 |
| CN | 103581810 | A | 2/2014 |
| CN | 104053103 | A | 9/2014 |
| CN | 204119498 | U | 1/2015 |
| CN | 104461115 | A | 3/2015 |
| CN | 108289134 | A | 7/2018 |
| CN | 108462917 | A | 8/2018 |
| CN | 108566602 | A | 9/2018 |
| CN | 207978119 | U | 10/2018 |
| CN | 108810764 | A | 11/2018 |
| CN | 109308849 | A | 2/2019 |
| CN | 109922412 | A | 6/2019 |
| CN | 110049415 | A | 7/2019 |
| EP | 2713235 | A1 | 4/2014 |
| EP | 3917165 | A1 | 12/2021 |
| JP | H11113093 | A | 4/1999 |
| JP | 2007110382 | A | 4/2007 |
| JP | 2008193486 | A | 8/2008 |
| JP | 2013207749 | A | 10/2013 |
| JP | 2018046526 | A | 3/2018 |
| KR | 20060066351 | A | 6/2006 |

* cited by examiner

VIBRATION AND SOUND-MAKING APPARATUS AND ELECTRONIC DEVICE

CROSS-REFERENCE TO RELATED APPLICATIONS

This application is a U.S. National Stage of International Patent Application No. PCT/CN2020/076423 filed on Feb. 24, 2020, which claims priority to Chinese Patent Application No. 201910210343.3 filed on Mar. 19, 2019. Both of the aforementioned applications are hereby incorporated by reference in their entireties.

TECHNICAL FIELD

The present invention relates to the field of sound-making technologies, and in particular, to a vibration and sound-making apparatus and an electronic device.

BACKGROUND

With development of technologies and consumer requirements, an external size of an electronic device such as a mobile terminal and a display becomes larger, and an industrial design of the electronic device becomes thinner. Especially, for an existing mobile phone, a size requirement for an internal component of the mobile phone becomes higher. However, a common sound-making apparatus in the electronic device implements a speaker function to make a sound by using a micro-magnetic speaker and a micro-vibration motor. However, this structure is complex, consumes a large amount of energy, occupies a large amount of internal space, and limits a light and thin design of a product.

SUMMARY

This application provides an electronic device and a vibration and sound-making apparatus, so that vibration of a driving diaphragm is used to drive air in a speaker box to vibrate to implement sound making. The driving diaphragm has a simple structure and can be disposed in a large area without occupying too much space of the electronic device. This facilitates a light and thin design of the electronic device.

In an embodiment, the electronic device includes a main body, a display disposed on the main body, and a sound-making assembly. The sound-making assembly includes a speaker box and a driving diaphragm located in the speaker box, the speaker box is disposed inside the main body or is formed by using the main body and the display, the main body is provided with a speaker grille corresponding to the speaker box, the driving diaphragm is fastened inside the speaker box and divides the speaker box into two sub-chambers, the speaker grille is connected to one of the sub-chambers, the driving diaphragm vibrates after receiving an audio signal, the driving diaphragm drives, through vibration of the driving diaphragm, air in the two sub-chambers to vibrate to make a sound, and the sound is spread through the speaker grille. There may be one speaker box, or there may be two or more speaker boxes, and there may be one or a plurality of driving diaphragms in each speaker box.

In the electronic device in this embodiment, the driving diaphragm vibrates by receiving the audio signal, and vibration of the driving diaphragm drives air in the two sub-chambers to constantly fluctuate, causing air fluctuation and forming a sound wave. Compared with an existing micro-magnetic speaker and a micro-vibration motor, the driving diaphragm has a simple structure, is relatively thin, and can be paved in a large area (an area of the diaphragm may be designed based on a length and a width of the electronic device). When volume and sound quality are ensured, the driving diaphragm does not need to occupy much space of the electronic device. This facilitates a light and thin design of the electronic device. For an electronic device in the prior art in which a moving magnetic coil is connected to a screen to drive the screen to vibrate to make a sound, although a sound is made through vibration, because the moving magnetic coil needs to drive the screen to make a sound, and the sound is made through vibration of the screen, and because the screen to be driven has relatively high weight, relatively large driving force is required, and energy consumption is relatively large. In addition, the screen is fastened all around. Consequently, neither volume nor audio performance of the generated sound can reach a level of a speaker of the electronic apparatus, only an earpiece can be replaced, and the generated sound cannot be used as a speaker sound. However, in the vibration and sound-making apparatus in this application, a light and thin driving diaphragm is used to drive the air in the speaker box to vibrate to make a sound, instead of driving a component with high weight and hardness such as a screen to make a sound. The driving diaphragm drives the air to vibrate to make a sound, and no additional driving force is required, so that not only energy can be saved, but also the volume and a sound effect can be ensured. Therefore, effects of the earpiece and the speaker can be achieved.

In some embodiments, there are a plurality of driving diaphragms, the plurality of driving diaphragms are disposed in parallel at intervals in a same direction, and all the driving diaphragms vibrate by receiving different audio signals, and drive air in the sub-chamber to vibrate to make sounds in a plurality of different frequency bands. In this implementation, a plurality of driving diaphragms of a same shape are disposed in parallel at intervals in a same direction (in a width direction), to reduce an occupied area. The plurality of driving diaphragms make sounds in different frequency bands after receiving audio signals, so that sound making in a plurality of frequency bands can be implemented. Therefore, a multimodality in each frequency band is excluded, a distortion effect in each frequency band is reduced, and sound quality of the vibration and sound-making apparatus is improved.

In some embodiments, a partition wall is further disposed between every two adjacent driving diaphragms, the partition wall divides the speaker box into a plurality of independent speaker sub-boxes, and each speaker sub-box is correspondingly provided with one speaker sub-grille. The plurality of speaker sub-boxes extend in a same direction and are disposed in parallel, so that audio in different frequency bands is emitted through the independent speaker sub-boxes. Every two driving diaphragms can be separated, so that when the plurality of driving diaphragms vibrate to make sounds, the plurality of driving diaphragms do not interfere with each other, to ensure volume, and improve sound quality of a sound made by the vibration and sound-making apparatus.

Further, the electronic device may further include a processor, and the processor is electrically connected to the plurality of driving diaphragms in the speaker box, and is configured to: send an audio signal to the plurality of driving diaphragms, and control the plurality of driving diaphragms to simultaneously vibrate and respectively work in different frequency bands, so that the speaker box makes sounds in a plurality of different frequency bands, and the vibration and sound-making apparatus produces a consistent and flat frequency response in all frequency bands, so as to improve sound quality. Certainly, the processor may further control one or some driving diaphragms to vibrate. In an implementation, each driving diaphragm is equipped with one driver circuit, the processor outputs a plurality of different audio signals to a plurality of driver circuits, and each driver circuit drives a driving diaphragm connected to the driver circuit to vibrate to make a sound. According to this solution, separate control can be implemented and performance of controlling each driving diaphragm is relatively good. In another implementation, the processor sends a same signal to one driver circuit, and the driver circuit separately transmits the same signal to the plurality of driving diaphragms after frequency division. In this manner, there is a simple structure.

In some embodiments, the electronic device includes two sound-making assemblies, two speaker boxes of the two sound-making assemblies are arranged in a length direction of the electronic device, the two speaker boxes are separated by a support body, each speaker box is provided with the speaker grille, and driving diaphragms in the two speaker boxes simultaneously vibrate to make sounds, so that the electronic device implements stereo sound making. One or more driving diaphragms are separately fastened in the two speaker boxes. Specifically, the support body is made of a metal material such as aluminum, and can implement quick heat dissipation of the vibration and sound-making apparatus. In the prior art, a magnetic actuator including a moving magnetic coil is connected to a screen to drive the screen to vibrate to make a sound, and a quantity of magnetic actuators needs to be increased to drive a screen with relatively high quality. Consequently, relatively large space is still occupied, stereo sound sources are separated inevitably unclearly, and even there is no stereo effect. However, in this application, only two sound-making assemblies including a speaker box and a driving diaphragm need to separately vibrate to make sounds, so that a stereo effect can be achieved, a size is small, and a loss is small.

In some embodiments, the speaker grilles corresponding to the two speaker boxes are symmetric about the support body, to further implement balanced sound-making of the vibration and sound-making apparatus.

When a stereo sound is made through two speaker boxes, in one case, the two speaker boxes are symmetric about the support body, and the driving diaphragms in the two speaker boxes are symmetric about the support body, so that the vibration and sound-making apparatus implements balanced stereo sound making, and sound quality of the electronic device is improved. It may be understood that when the two speaker boxes are rectangular cubical space, lengths, widths, and thicknesses of the two speaker boxes are equal, and shapes and areas of the driving diaphragms in the two speaker boxes are equal, to ensure that the two speaker boxes make a balanced stereo sound. In another case, the two speaker boxes are symmetric about the support body, and areas of the driving diaphragms in the two speaker boxes are different. Alternatively, when the two speaker boxes are asymmetric, and the driving diaphragms in the two speaker boxes have a same area or different areas, the vibration and sound-making apparatus is further connected to a modulator, and the modulator adjusts an audio signal to maintain balanced sounds made through vibration of the driving diaphragms in the two speaker boxes, namely, balanced sounds made through a left audio channel and a right audio channel. The modulator adjusts, according to a digital signal processing algorithm, audio signals that are input into the driving diaphragms in the two speaker boxes, so that a sound effect is kept balanced when the driving diaphragms in the two speaker boxes vibrate, to implement a balanced stereo sound of the vibration and sound-making apparatus.

In some embodiments, the speaker box includes a box surface, a protective film is stacked on the box surface, and the speaker grille penetrates the protective film. The protective film is stacked on the box surface, to avoid a case in which other substances such as external moisture enter the speaker box through the speaker grille, and damage a display or a component in the main body.

In some embodiments, the driving diaphragm is a piezoelectric ceramic element. When receiving an audio signal, the piezoelectric ceramic element vibrates according to a frequency of the signal, and drives air on a surface of the piezoelectric ceramic element to vibrate to generate a sound wave, so as to generate sound quality with relatively good high-frequency performance.

In some other embodiments of the driving diaphragm, the driving diaphragm includes a piezoelectric ceramic element and a diaphragm, the piezoelectric ceramic element is disposed on a surface of the diaphragm or the diaphragm is disposed around a periphery of the piezoelectric ceramic element, and the piezoelectric ceramic element drives the diaphragm to vibrate. The piezoelectric ceramic element and the diaphragm drive, through vibration of the piezoelectric ceramic element and the diaphragm, air inside the two sub-chambers to vibrate to make a sound. Because the diaphragm is elastic to some extent, the diaphragm may store energy during vibration, to improve low-frequency performance of a sound made by the vibration and sound-making apparatus. The diaphragm may be made of an elastic material such as polycarbonate (PC, Polycarbonate) or polyetheretherketone (Peek, Polyetherketone).

In some embodiments, the driving diaphragm further includes an edge, the edge is disposed around a periphery of the diaphragm, and the diaphragm drives the edge to vibrate. The edge drives, through vibration of the edge, air inside the speaker box to vibrate to make a sound. Because the edge is elastic, the edge may correspondingly store energy during vibration, to increase a vibration amplitude, and improve low-frequency performance and linearity of a sound made by the vibration and sound-making apparatus.

In some embodiments, there are a plurality of piezoelectric ceramic elements, and the plurality of piezoelectric ceramic elements are disposed in a stacked manner. Compared with a single piezoelectric ceramic element, the plurality of piezoelectric ceramic elements receive audio signals and vibrate at a larger amplitude. This helps improve loudness of a sound made by the vibration and sound-making apparatus.

In the embodiments, in some embodiments of a method for fastening the driving diaphragm, an end of the driving diaphragm is fastened to a box wall of the speaker box, and the other end and the speaker box are disposed at an interval. To be specific, the driving diaphragm is in a cantilever state, and the driving diaphragm vibrates by receiving an audio signal, so that the vibration and sound-making apparatus makes a sound relatively naturally.

The driving diaphragm includes a fixed end and a free end that are disposed opposite to each other, the fixed end is fastened to the box wall, an amplitude of the free end is relatively large when the driving diaphragm vibrates, and a sound wave in the speaker box is naturally spread from the speaker grille, so that the electronic device makes a sound naturally. Further, the modulator of the electronic device may further adjust, according to the digital signal processing algorithm and a real-time control algorithm, the audio signal input into the driving diaphragm, to avoid a case in which vibration cannot be stopped in a timely manner due to signal interruption that occurs when the driving diaphragm vibrates, to avoid generation of an echo, and to ensure that the electronic device stably makes a sound. Alternatively, a damping structure is disposed on the driving diaphragm, so that vibration can be stopped in a timely manner when the driving diaphragm is in the cantilever state and a signal stops, so that the vibration and sound-making apparatus makes a sound stably.

In some embodiments, the periphery of the driving diaphragm is fastened to the box wall of the speaker box. The driving diaphragm is bent by receiving an audio signal and drives air to vibrate, to ensure that the electronic device makes a sound effectively and stably. In addition, the modulator may be disposed, and the modulator is configured to pre-control, according to the digital signal processing algorithm, the audio signal input into the driving diaphragm, to avoid a nonlinear problem and a total harmonic distortion problem that occur when the driving diaphragm makes a sound and is bent.

In some embodiments, the driving diaphragm includes a diaphragm and a piezoelectric ceramic support body, the piezoelectric ceramic support body supports the diaphragm in the speaker box, and the piezoelectric ceramic support body vibrates by receiving an audio signal, and drives the diaphragm to make a piston motion in the speaker box, so that air in the sub-chamber vibrates to make a sound.

In some embodiments, the plurality of driving diaphragms in the speaker box are fastened in a same manner, or the plurality of driving diaphragms in the speaker box are fastened in different manners. When only one fastening end of each of the driving diaphragm in the speaker box is fastened to the box wall of the speaker box, fastening ends of the plurality of driving diaphragms are fastened to a same box wall of the speaker box, to facilitate assembly.

In some embodiments, the electronic device includes a waterproof valve and a valve controller, the waterproof valve is disposed on a side part of the speaker grille, and the valve controller controls, based on the humidity value of the speaker grille, the waterproof valve to close or open the speaker grille, to prevent external moisture from entering the speaker box and causing damage to the vibration and sound-making apparatus.

In some embodiments, in a thickness direction of the driving diaphragm, a thickness of the speaker box is between 0.05 mm and 0.5 mm.

In some embodiments, the electronic device includes a modulator, and the modulator adjusts an audio signal, so that two driving diaphragms maintain balanced vibration and sound-making.

In some embodiments, the electronic device includes a component cooperating with the display, the main body includes a middle frame and a rear housing, the middle frame includes a support plate, the rear housing and the display are fastened on two opposite sides of the middle frame, the support plate and each of the rear housing and the display are disposed at an interval in a stacked manner, and the component is convexly disposed on the support plate and is isolated from the speaker box; and the speaker box is located between the display and the support plate of the middle frame and is enclosed by the middle frame and the display, the speaker box is located between the rear housing and the support plate of the middle frame and is enclosed by the middle frame and the rear housing, or the speaker box is disposed inside the rear housing.

In some embodiments, the middle frame includes a first end frame and a second end frame that are disposed opposite to each other, a first side frame and a second side frame that are disposed opposite to each other and that are separately connected to the first end frame and the second end frame, and the support plate around which the first end frame, the second end frame, the first side frame, and the second side frame are connected, an isolation frame is disposed on the support plate, and the isolation frame is used as a partial box wall of the speaker box and isolates the component from the driving diaphragm.

In some embodiments, the component is a front-facing camera module, the camera module is located on a side that is of the support plate and that is away from the display, the middle frame includes a first end frame and a second end frame that are disposed opposite to each other, a first side frame and a second side frame that are disposed opposite to each other and that are separately connected to the first end frame and the second end frame, and the support plate around which the first end frame, the second end frame, the first side frame, and the second side frame are connected, a light-through hole opposite to the camera module is disposed on the support plate, and a through hole corresponding to the light-through hole is disposed on the driving diaphragm.

In some embodiments, the rear housing includes a first housing and a second housing, and the first housing and the second housing are snap-fitted to form the speaker box.

In some embodiments, a component of the electronic device is a rear-facing camera module, and a view window is disposed on the second housing and is used by the camera module located on the support plate to collect light; and the driving diaphragm is provided with an opening that is opposite to and in communication with the view window, or the driving diaphragm and the view window are isolated by an isolation frame.

In this embodiment, a middle frame structure is used to isolate a component that needs to cooperate with a rear cover or a display (transparent) and that has a relatively large thickness, such as a speaker box, a driving diaphragm, and a camera module, to avoid mutual interference. In addition, in this embodiment, a structure of the electronic device forms the speaker box, and the electronic device cooperates with the driving diaphragm to implement vibration and sound making. The structure is simple and easy to implement, and internal space of the electronic device is saved. In addition, effects of an earpiece and a speaker or even a stereo sound effect may be achieved, and volume and sound quality can be ensured.

An embodiment provides a vibration and sound-making apparatus, including a case and a driving diaphragm. A speaker box is disposed inside the case and the case is provided with a speaker grille corresponding to the speaker box, the driving diaphragm is fastened inside the speaker box and divides the speaker box into two sub-chambers, the speaker grille is connected to one of the sub-chambers, the driving diaphragm vibrates after receiving an audio signal, the driving diaphragm drives, through vibration of the driving diaphragm, air in the two sub-chambers to vibrate to make a sound, and the sound is spread through the speaker grille. The vibration and sound-making apparatus may be used as an independent audio device to make a sound. The vibration and sound-making apparatus has a simple structure and a small size, and can ensure volume and sound quality.

In some embodiments, there are a plurality of driving diaphragms, the plurality of driving diaphragms are disposed in parallel at intervals in a same direction, and each of the driving diaphragms vibrates by receiving different audio signals, and drives air in the sub-chamber to vibrate, so that the vibration and sound-making apparatus makes sounds in a plurality of different frequency bands.

In some embodiments, a partition wall is further disposed between every two adjacent driving diaphragms, the partition wall divides the speaker box into a plurality of independent speaker sub-boxes, and each speaker sub-box is correspondingly provided with one speaker sub-grille, to ensure a sound effect of each frequency band.

In some embodiments, two speaker boxes are disposed inside the case and there is a driving diaphragm inside each speaker box, the two speaker boxes are arranged in sequence in a length direction of the case, the two speaker boxes are separated by a support body, each speaker box is provided with the speaker grille, and driving diaphragms in the two speaker boxes simultaneously vibrate to make sounds, so that the vibration and sound-making apparatus implements stereo sound making.

In some embodiments, the two speaker boxes are symmetric about the support body, the diaphragms in the two speaker boxes are symmetric about the support body, and the speaker grilles corresponding to the two speaker boxes are symmetric about the support body, to improve a balance of a sound.

In some embodiments, the vibration and sound-making apparatus includes a processor, the processor is electrically connected to the plurality of driving diaphragms in the speaker box, and is configured to: send an audio signal to the driving diaphragm, and control the plurality of driving diaphragms to respectively work in different frequency bands.

In some embodiments, the vibration and sound-making apparatus includes a modulator, and the modulator adjusts an audio signal, so that two driving diaphragms maintain balanced vibration and sound-making.

An embodiment provides an electronic device, including a main body and the vibration and sound-making apparatus. The main body is provided with a through hole corresponding to a speaker grille, and the vibration and sound-making apparatus is disposed inside the main body, so that the electronic device makes a sound.

In some embodiments, the electronic device includes a display, the main body includes a middle frame provided with a support body and a rear housing disposed on the middle frame, the display is disposed on the middle frame, and the display and the rear housing are located on two sides of the support body. The vibration and sound-making apparatus is disposed in a gap between the support body and the rear housing; or the vibration and sound-making apparatus is disposed in a gap between the support body and the display. The electronic device may be a headset, a mobile phone, a notebook computer display, a tablet computer, a personal digital assistant, a portable multimedia player, a navigation device, a smartwatch, and an electronic apparatus that needs a loudspeaker, such as a digital television display or a desktop computer. A display is disposed on the main body, and the vibration and sound-making apparatus is disposed inside the main body, or the vibration and sound-making apparatus is disposed in a gap between the main body and the display. The electronic device in this application uses a vibration and sound-making apparatus that has a simple structure, can generate stereo sound, and has a relatively small size. This is conducive to a light and thin design of the electronic device, and can ensure volume and sound quality of the electronic device.

In the vibration and sound-making apparatus in this application, the driving diaphragm vibrates by receiving an audio signal, and vibration of the driving diaphragm drives air in the two sub-chambers to constantly fluctuate, causing air fluctuation and forming a sound wave. The vibration and sound-making apparatus has a simple structure. When the vibration and sound-making apparatus is applied to the electronic device, the vibration and sound-making apparatus does not need to occupy relatively large space of the electronic device. This facilitates a light and thin design of the electronic device.

BRIEF DESCRIPTION OF DRAWINGS

To describe the technical solutions in the embodiments of this application more clearly, the following briefly describes the accompanying drawings required for describing the embodiments or the prior art. Definitely, the accompanying drawings in the following description merely show some embodiments of this application, and a person of ordinary skill in the art may still derive other drawings from these accompanying drawings without creative efforts.

DESCRIPTION OF EMBODIMENTS

The following clearly describes the technical solutions in the implementations with reference to the accompanying drawings in the implementations.

An embodiment provides a vibration and sound-making apparatus. The vibration and sound-making apparatus may be an electronic device such as a mobile phone, a notebook computer display, a tablet computer, a personal digital assistant, a portable multimedia player, a navigation device, a smartwatch, a headset, a digital television display, or a desktop computer. Certainly, the vibration and sound-making apparatus may alternatively be an independent component, and may be directly disposed inside the foregoing electronic device, so that the electronic device can make a sound. The following describes a vibration and sound-making apparatus by using specific embodiments, including a specific embodiment in which the vibration and sound-making apparatus is an electronic device, a specific embodiment in which the vibration and sound-making apparatus is used as an independent device, and an embodiment in which the vibration and sound-making apparatus that is used as an independent device is disposed in an electronic device that needs to make a sound.

Figure 1:
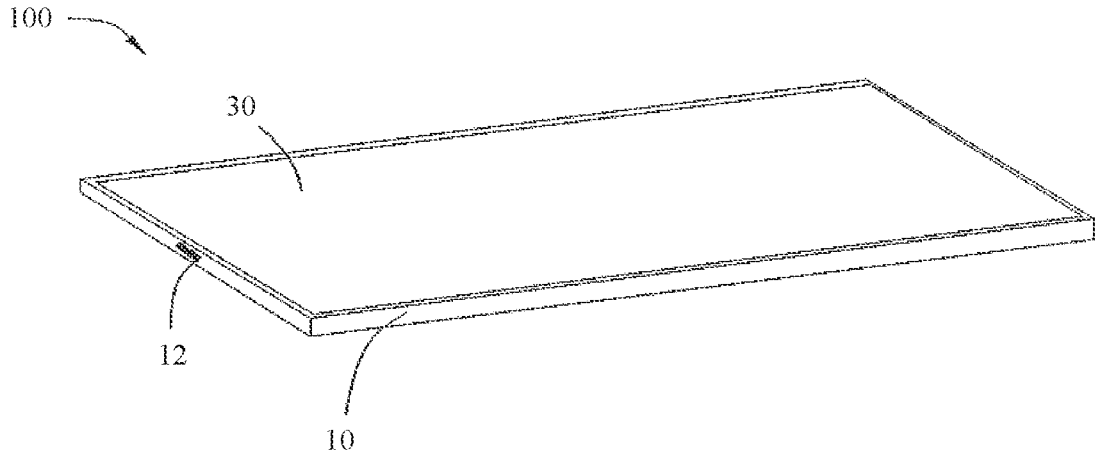
FIG. 1 is a schematic diagram of a three-dimensional structure of an electronic device according to an embodiment.

The embodiment of the vibration and sound-making apparatus is described by using an electronic device as an example. FIG. 1 is a schematic diagram of a three-dimensional structure of an electronic device according to the present invention. A speaker box and a driving diaphragm inside the electronic device, and a matching relationship between the speaker box and the driving diaphragm change with the embodiment. For details, refer to schematic diagrams of internal cross sections in the embodiments. An appearance shape in FIG. 1 is merely an example of the mobile phone, and does not represent an appearance shape and a size of an actual product, and does not represent that an internal structure is unique.

Figure 2:
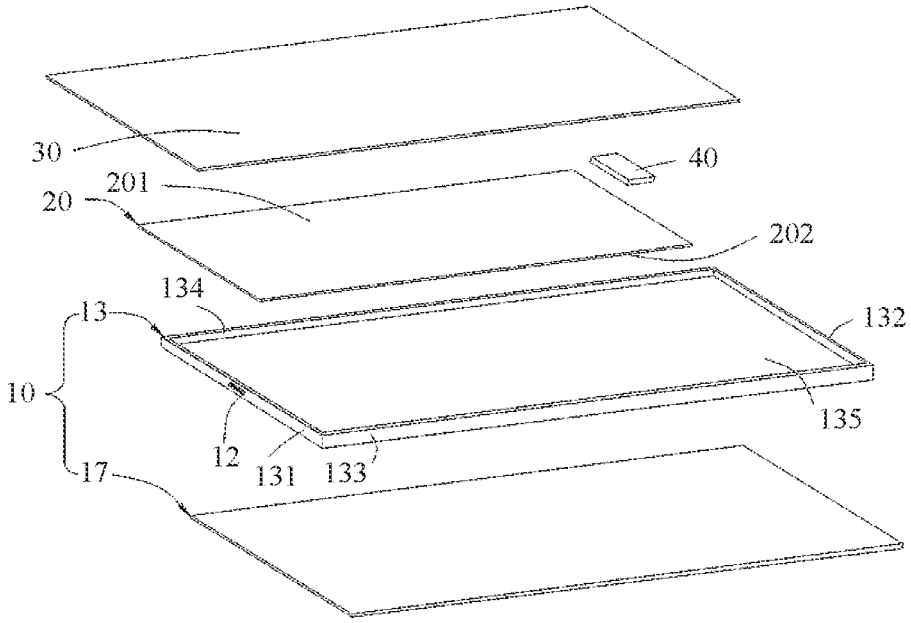
FIG. 2 is a schematic exploded structural diagram of a first embodiment of the electronic device shown in FIG. 1, where a speaker box and a driving diaphragm are located between a display and a middle frame, and a manner of isolating the speaker box and the driving diaphragm from a camera module is not drawn.

For a first embodiment of the electronic device in the present invention, specifically refer to FIG. 2. FIG. 2 is a schematic exploded view of the first embodiment of the electronic device shown in FIG. 1. The electronic device 100 includes a main body 10, a display 30 stacked on the main body 10, and a sound-making assembly. The main body 10 includes a middle frame 13 and a rear housing 17 disposed on the middle frame 13. The sound-making assembly includes a speaker box and a speaker box of a driving diaphragm 20 accommodated in the speaker box (not shown in the figure), and the speaker box is connected to a speaker grille 12 disposed on the main body 10. The driving diaphragm 20 is fastened inside the speaker box, and divides the speaker box into two sub-chambers. The speaker grille 12 is connected to one sub-chamber. The driving diaphragm 20 vibrates after receiving an audio signal, the driving diaphragm 20 drives, through vibration of the driving diaphragm 20, air in the two sub-chambers to vibrate to make a sound, and the sound is spread through the speaker grille 12.

In some embodiments, there may be one speaker box, or two speaker boxes may cooperate to implement stereo sound making. A position of the speaker grille cooperating with the speaker box may be set according to an actual requirement, provided that fastening of the driving diaphragm 20 is not affected. There may be one driving diaphragm 20, or a plurality of driving diaphragms 20 may cooperate with each other to implement complete sound making. The speaker box is located between the middle frame 13 and the display 30, and is enclosed by the middle frame 13 and the display 30. Alternatively, the speaker box is located between the rear housing 17 and the middle frame 13, and is enclosed by the rear housing 17 and the middle frame 13. Alternatively, the speaker box is located inside the rear housing 17. In these embodiments, the speaker box is formed mainly by using a structure of the electronic device, the speaker box is simple to form, and an overall thickness of the electronic apparatus can be reduced.

Specifically, the middle frame 13 includes a first end frame 131 and a second end frame 132 that are disposed opposite to each other, a first side frame 133 and a second side frame 134 that are disposed opposite to each other and that are separately connected to the first end frame 131 and the second end frame 132, and a support plate 135 around which the first end frame 131, the second end frame 132, the first side frame 133, and the second side frame 134 are connected. The rear housing 17 and the display 30 are fastened to the middle frame 13 and are located on two opposite sides of the support plate 135. The electronic device 100 further includes a camera module 40, a flash light, a fingerprint module, and other functional components that are disposed on the main body 10 (for example, on the support plate 135 of the middle frame). When there is a need in a specific design of an internal structure of the electronic device, the speaker box or the driving diaphragm avoids the camera module when being disposed, and certainly, may also avoid another electrical component that is disposed on the middle frame 13 and that cooperates with the display 30 or the rear housing 17.

Figure 3:
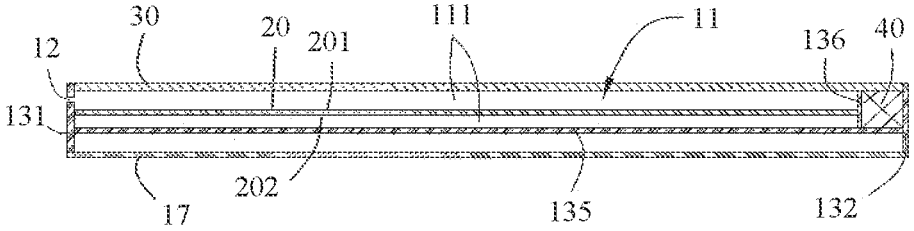
FIG. 3 is a sectional view obtained after the electronic device shown in FIG. 2 is cut in a length direction after being assembled, where an adaptation manner in which a speaker box and a driving diaphragm are isolated from a camera module by using an isolation frame is shown.

Referring to FIG. 3 together, in this embodiment, the speaker box is located between the display 30 and the middle frame 13. There is one speaker box 11, and there is one driving diaphragm 20. The driving diaphragm 20 is fastened to a box wall of the speaker box 11, and divides the speaker box 11 into two sub-chambers 111. The speaker grille 12 is disposed on the middle frame 13 and is connected to one sub-chamber 111, and the driving diaphragm 20 drives, through vibration of the driving diaphragm 20, air in the two sub-chambers 111 to vibrate, to make a sound.

Specifically, an adaptation manner in which the speaker box 11 and the driving diaphragm 20 are isolated from the camera module 40 through an isolation frame 136 is as follows: The isolation frame 136 is disposed in a position that is on the support plate 135 on the middle frame 13 and that is close to the second end frame 132. The isolation frame 136 is located between the support plate 135 and the display 30 and is hermetically connected to the support plate 135 and the display 30, and the isolation frame 136 on the middle frame 13 is connected to the first side frame 133 and the second side frame 134. In this embodiment, the display 30 and the support plate 135 are disposed at an interval in a stacked manner to form a gap, and the first end frame 131, the first side frame 133, and the second side frame 134 of the middle frame 13, and the isolation frame 136 surround the gap to form the speaker box 11. The driving diaphragm 20 is located inside the speaker box 11 and is fastened to the box wall. For a specific fastening manner, refer to a subsequent implementation. The driving diaphragm 20 is of a rectangular film structure. In a thickness direction of the driving diaphragm 20, a thickness of the speaker box 11 is between 0.05 mm and 0.5 mm, to provide sufficient vibration space for a vibration amplitude to be achieved by the driving diaphragm 20. The driving diaphragm 20 includes a first side 201 and a second side 202 that are approximately parallel and disposed opposite to each other. The first side 201 faces the display 30, the second side 202 faces the support plate 135 on the middle frame 13, and the driving diaphragm 20 is approximately parallel to the display 30, to ensure uniformity of air driven during vibration. It may be understood that, in another embodiment, there may be an included angle between the driving diaphragm 20 and each of the display 30 and the support plate 135. Actually, provided that volume and sound quality of a sound made by the vibration and sound-making apparatus are not affected, it does not matter, for the vibration and sound-making apparatus in this application, whether the two oppositely disposed surfaces of the driving diaphragm are absolutely parallel, and whether there is an included angle between the driving diaphragm 20 and each of the display 30 and the support plate 135. The speaker grille 12 is formed by arranging a plurality of tiny holes at intervals, and is specifically disposed on the first end frame 131 to connect the speaker box 11 to an external environment, so as to transmit a sound generated in the speaker box 11 to the external environment. Certainly, the speaker grille 12 may alternatively be disposed in another position on the middle frame 13, provided that assembly and sound making of the driving diaphragm 20 are not affected. A regular area is formed between the isolation frame 136 on the middle frame 13 and the second end frame 132, and is used to accommodate a component such as the camera module 40, so that the camera module 40 performs light capture and photographing through a light-capture window disposed on the display, without affecting forming of the speaker box.

Figure 4A:
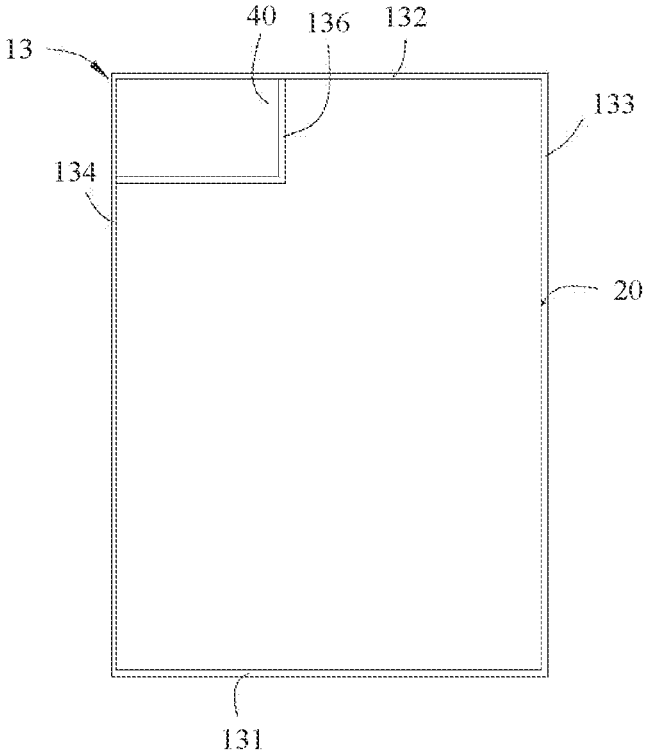
FIG. 4*a* is a sectional view of another adaptation manner in which a speaker box and a driving diaphragm of the electronic device shown in FIG. 2 are isolated from a camera module by using an isolation frame.

A second adaptation manner in which the speaker box 11 and the driving diaphragm 20 are isolated from the camera module in this embodiment is shown in FIG. 4*a*. The isolation frame 136 is connected to the second end frame 132 and surrounds the camera module 40. Only the camera module 40 needs to be isolated, and other positions are not isolated. The driving diaphragm 20 may avoid the camera module 40. This does not affect sound making of the driving diaphragm 20, and does not affect cooperation between the camera module 40 and the display 30 or the rear housing 17. In this embodiment, the first end frame 131, the first side frame 133, a part of the second side frame 134, a part of the second end frame 132, and the isolation frame 136 surround the gap to form the speaker box 11.

Figure 4B:
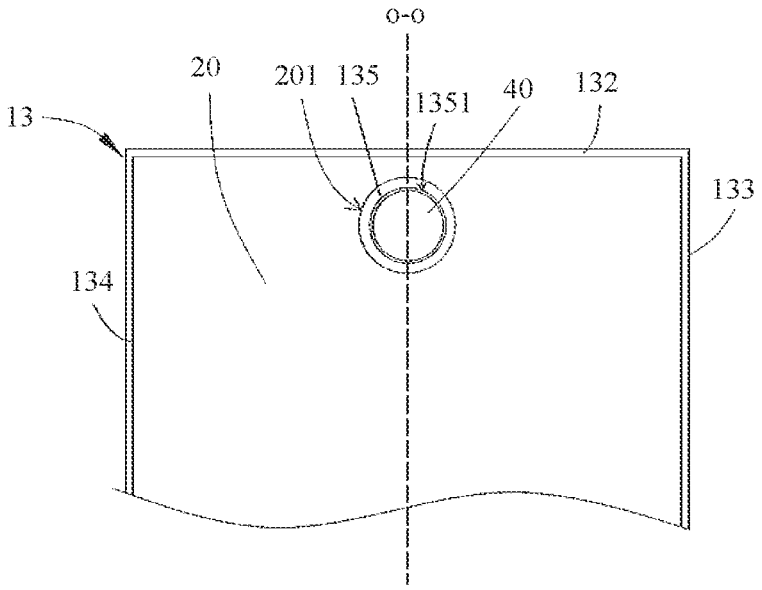
FIG. 4*b* is a top view of a third adaptation manner in which a speaker box and a driving diaphragm of the electronic device shown in FIG. 2 avoid a camera module.
Figure 4C:
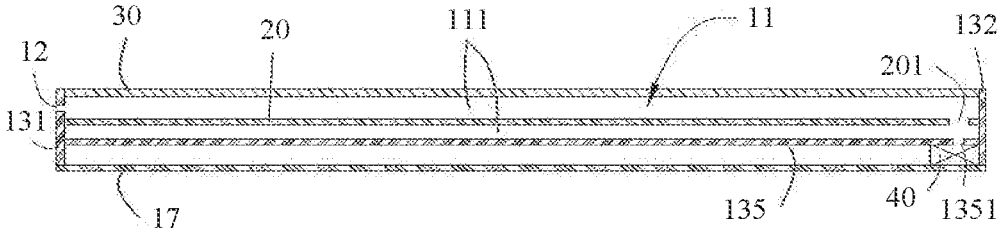
FIG. 4*c* is a schematic diagram of a sectional view along an O-O direction in the third adaptation manner, shown in FIG. 4*b*, in which a driving diaphragm avoids a camera module.

As shown in FIG. 4*b* and FIG. 4*c*, in a third adaptation manner in which the driving diaphragm is isolated from the camera module in this embodiment, the isolation frame 136 is removed from the middle frame 13, components such as the camera module 40 and the flash light are placed on a surface that is of the support plate 135 and that is away from the display 30, a light-through hole is disposed on the support plate 135, and a through hole 201 is disposed in a position corresponding to the driving diaphragm 20. The display 30 and the support plate 135 are disposed at an interval in a stacked manner to form a gap, and the first end frame 131, the second end frame 132, the first side frame 133, and the second side frame 134 of the middle frame 13 surround the gap to form the speaker box. When the driving diaphragm 20 is located inside the speaker box 11, the light-through hole 1351 and the through hole 201 cooperate with the display 30, so that the camera module 40 can capture light. In this way, performance of the camera module 40 can be ensured. Sizes of the light-through hole and the through hole 201 are greater than a maximum peripheral size of the camera module 40, to ensure that the camera module 40 captures light. An area of the driving diaphragm 20 in this embodiment may be set based on an actual size of a gap between the middle frame 13 and the display 30, provided that vibration and fastening of the driving diaphragm 20 are not affected. In other words, the driving diaphragm in this structure may be paved in a maximum area in the main body 10, so that volume and sound quality can be improved, and space of the electronic device can be saved. It should be noted that the camera module 40 is a front-facing camera, and the isolation frame 136 may be directly formed by using a bracket that supports the camera module 40, so as to make full use of an internal component of the mobile phone, save space, and simplify a process.

In some embodiments, a protective film (not shown in the figure) is stacked on a surface of the box wall of the speaker box 11, the speaker grille 12 penetrates the protective film, and the protective film prevents external moisture and other impurities from entering the display 30 and the middle frame 13 from the speaker box 11 and damaging an electronic component, to avoid damaging the electronic device 100.

Figure 5A:
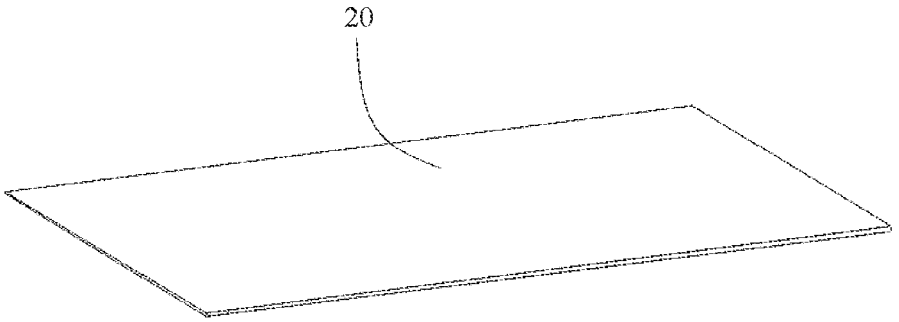
FIG. 5*a*, FIG. 5*b*, FIG. 5*c*, and FIG. 5*d* are schematic diagrams of different implementations of a driving diaphragm of the electronic device shown in FIG. 1.

Referring to FIG. 5*a*, in an implementation of the driving diaphragm 20, the driving diaphragm 20 is a piezoelectric ceramic element, the piezoelectric ceramic element serves as a vibration source to directly receive an audio signal and vibrate to drive air on two sides of the piezoelectric ceramic element to vibrate to generate a sound wave, so as to generate sound quality with relatively good high-frequency performance. In another implementation, there are a plurality of piezoelectric ceramic elements, and the plurality of piezoelectric ceramic elements are disposed in a stacked manner. Compared with a single piezoelectric ceramic element, the plurality of piezoelectric ceramic elements receive audio signals and vibrate at a larger amplitude. This helps improve loudness of a sound made by the vibration and sound-making apparatus 100. In addition, a piezoelectric material is directly used as a vibration source to vibrate to make a sound, and does not need to be driven by another element, thereby reducing occupied internal space of the electronic device. The piezoelectric ceramic element is not electrically conductive, and does not affect a signal of the mobile phone, in other words, does not affect performance of an antenna.

Figure 5B:
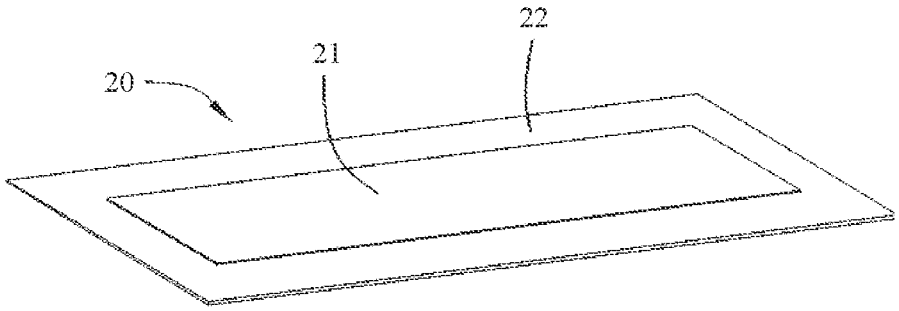

Referring to FIG. 5*b*, in another implementation of the driving diaphragm 20, the driving diaphragm 20 includes a piezoelectric ceramic element 21 and a diaphragm 22. The piezoelectric ceramic element 21 and the diaphragm 22 are sheet-like, and an area of the piezoelectric ceramic element 21 is less than an area of the diaphragm 22. The piezoelectric ceramic element 21 is disposed on a surface of the diaphragm 22 in a stacked manner, the piezoelectric ceramic element 21 drives the diaphragm 22 to vibrate, and the piezoelectric ceramic element 21 and the diaphragm 22 drive, through vibration of the piezoelectric ceramic element 21 and the diaphragm 22, air in the two sub-chambers 111 to vibrate to make a sound. Because the diaphragm 22 is elastic to some extent, the diaphragm 22 may store energy during vibration, to improve low-frequency performance of a sound made by the electronic device 100. The diaphragm 22 may be made of an elastic material such as polycarbonate (PC, Polycarbonate) or polyetheretherketone (Peek, Polyetheretherketone), to ensure that the diaphragm 22 may store energy during vibration. It should be noted that in another implementation, the diaphragm may be disposed around a periphery of the piezoelectric ceramic element. This is not specifically limited in this application.

Figure 5C:
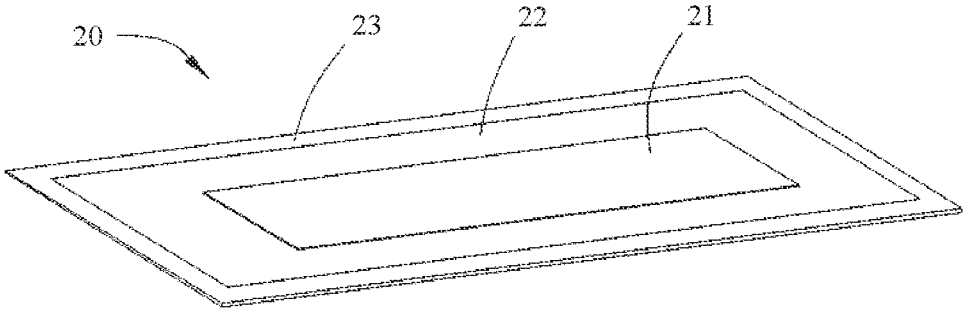

Referring to FIG. 5*c*, in a third implementation of the driving diaphragm 20, a difference from the implementation shown in FIG. 5*b* lies in that the driving diaphragm 20 further includes an edge 23, and the edge 23 is disposed around a periphery of the diaphragm 22. The piezoelectric ceramic element 21 drives the diaphragm 22 to vibrate, the diaphragm 22 drives the edge 23 to vibrate, and the piezoelectric ceramic element 21, the diaphragm 22, and the edge 23 drive, through vibration of the piezoelectric ceramic element 21, the diaphragm 22, and the edge 23, air in the speaker box 11 to vibrate to make a sound. Because the edge 23 is elastic, the edge 23 may correspondingly store energy during vibration, to increase an amplitude at which air vibrates, and improve low-frequency performance and linearity of a sound made by the electronic device. It should be noted that, in the foregoing three implementations of the driving diaphragm 20 in this embodiment, the driving diaphragm 20 is of a sheet-like structure and has an approximately uniform thickness.

Figure 5D:
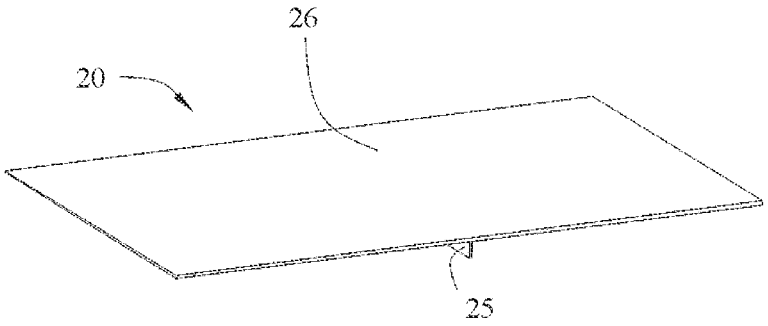

Referring to FIG. 5*d*, in a fourth implementation of the driving diaphragm 20, different from the foregoing implementations, the driving diaphragm 20 includes a diaphragm 26 and a piezoelectric ceramic support body 25, and the piezoelectric ceramic support body 25 is fixedly connected to a middle position on a surface of the diaphragm 26. A length direction of the piezoelectric ceramic support body 25 is the same as a width direction of the diaphragm 26, and a width of the diaphragm 26 is greater than a length of the piezoelectric ceramic support body 25. The piezoelectric ceramic support body 25 supports the diaphragm 26 in the speaker box 11. The piezoelectric ceramic support body 25 vibrates by receiving an audio signal, and drives the diaphragm 26 to perform a piston motion in the speaker box 11 to vibrate to make a sound. In other words, the diaphragm 26 drives air on two sides of the diaphragm 26 to vibrate, so that the diaphragm 26 uniformly drives air to vibrate. In another implementation, there may be two piezoelectric ceramic support bodies 25, and the two piezoelectric ceramic support bodies 25 jointly support the diaphragm 26 to ensure that the diaphragm 26 vibrates stably.

Further, referring to FIG. 3 again, in a case of the driving diaphragms in FIG. 5*a*, FIG. 5*b*, and FIG. 5*c*, a fastening manner of the driving diaphragm 20 is as follows: The periphery (the periphery surrounds the first side 201 and the second side 202) of the driving diaphragm 20 is fastened to the box wall of the speaker box 11, and the speaker box 11 is divided into two mutually isolated sub-chambers 111. In other words, the periphery of the driving diaphragm 20 is fastened to the first end frame 131, the first side frame 133, and the second side frame 134 on the middle frame 13, and an inner surface that is of the isolation frame 136 and that faces the speaker box 11. The driving diaphragm 20 bends and vibrates by receiving an audio signal, to drive air inside the two sub-chambers 111. To be specific, air on two sides of the driving diaphragm 20 vibrates, so as to make a sound and transmit the sound through the speaker grille 12. Assembly in this fastening manner is easy to implement, and it is ensured that the electronic device 100 makes a sound effectively and stably. Further, the electronic device 100 may further include a modulator, and the modulator pre-controls, according to a digital signal processing (DSP, Digital Signal Processing) algorithm, an audio signal input into the driving diaphragm 20, so as to avoid a nonlinear problem and a total harmonic distortion (THD, Total Harmonic Distortion) problem that occur when the driving diaphragm 20 is bent and drives air to vibrate.

Figure 6A:
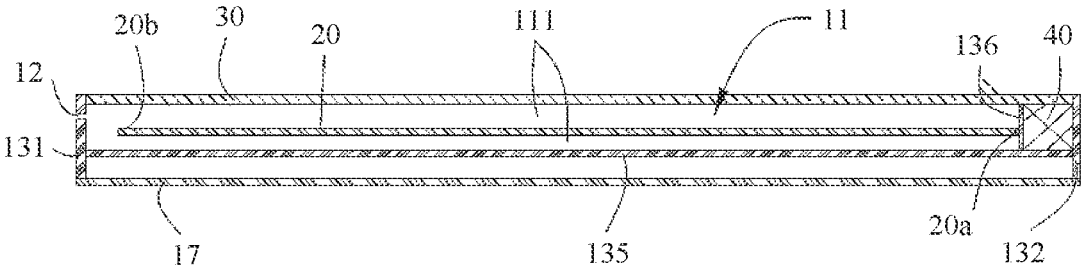
FIG. 6*a* shows that the driving diaphragm in the first embodiment of the electronic device shown in FIG. 2 is fastened inside the speaker box in a cantilever manner.

Referring to FIG. 6*a*, in another fastening manner of the driving diaphragm 20 in this embodiment, the driving diaphragm 20 is fastened in a cantilever manner. To be specific, one side (a part of the periphery) of the driving diaphragm 20 is fastened to the box wall of the speaker box 11. The other sides are in a non-fastened state and are at a specific distance from the box wall of the speaker box 11. In this fastening manner, the driving diaphragm 20 is in a cantilever state. Specifically, the driving diaphragm 20 includes a fastening end 20*a* and a free end 20*b* that are disposed opposite to each other. The fastening end 20*a* is fastened to a box wall opposite to the speaker grille 12, namely, the isolation frame 136. The free end 20*b* is disposed in a suspended manner and faces the speaker grille 12. When the driving diaphragm 20 vibrates, vibration force extends from the fastening end 20*a* to the free end 20*b*, an amplitude of the free end 20*b* is relatively large, and a sound wave in the speaker box 11 is naturally spread from the speaker grille 12, so that the electronic device 100 naturally makes a sound. Further, the electronic device 100 further includes a modulator, and the modulator may further adjust, according to a digital signal processing algorithm and a real-time control algorithm, an audio signal input into the driving diaphragm 20, to avoid a case in which vibration cannot be stopped in a timely manner due to signal interruption that occurs when the driving diaphragm 20 vibrates, to avoid generation of an echo, and to ensure that the electronic device 100 makes a sound stably. It should be noted that, in another embodiment, a damping structure is disposed on the driving diaphragm 20, so that vibration can be stopped in a timely manner when a signal of the driving diaphragm 20 stops, to avoid generation of an echo. In the foregoing two fastening manners, the driving diaphragms shown in FIG. 5*a*, FIG. 5*b*, and FIG. 5*c* may be used.

Figure 6B:
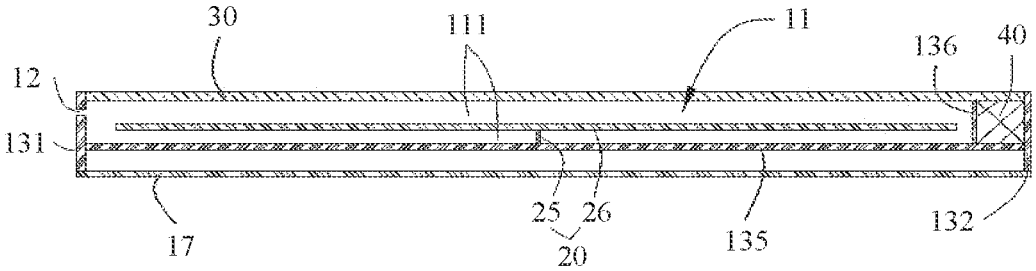
FIG. 6*b* shows that the driving diaphragm referred to in FIG. 5*d* is used in the first embodiment of the electronic device shown in FIG. 2, and is fastened in a manner in which a piezoelectric ceramic support body is fastened in the speaker box to support a diaphragm.

Referring to FIG. 6*b*, in a third fastening manner of the driving diaphragm 20 in this embodiment, in an implementation of the driving diaphragm 20 shown in FIG. 5*d*, the piezoelectric ceramic support body 25 supports the diaphragm 26 in the speaker box 11, the piezoelectric ceramic support body 25 is fastened to the support plate 135 of the middle frame 13, and the periphery of the diaphragm 26 is separated from the box wall of the speaker box 11. The piezoelectric ceramic support body 25 vibrates by receiving an audio signal, and drives the diaphragm 26 to perform a piston motion in the speaker box 11 to vibrate to make a sound. In other words, the diaphragm 26 drives air on two sides of the diaphragm 26 to vibrate, so that the diaphragm 26 uniformly drives air to vibrate. It should be noted that, the driving diaphragm in the foregoing embodiment is fastened to the speaker box 11 to divide the speaker box into two sub-chambers. Using the structure of the driving diaphragm in the fourth manner and this fastening manner specifically means that the vibration membrane 26 divides the speaker box 11 into two sub-chambers, one sub-chamber is located between the diaphragm 26 and the display 30, the other sub-chamber is located between the diaphragm 26 and the support plate 135, and the piezoelectric ceramic support body 25 is located inside the sub-chamber. The diaphragm in this implementation can vibrate more uniformly to generate more uniform sound quality.

In the electronic device 100 in this embodiment, the driving diaphragm 20 directly vibrates to make a sound in the speaker box 11. Compared with an existing common speaker, a micro-magnetic speaker, and a micro-vibration motor, this structure is simple and occupies less space, is suitable for a light and thin design of the electronic device, and can ensure volume and sound quality. For an electronic device in the prior art in which a moving magnetic coil and a piezoelectric ceramic element are connected to a screen to drive the screen to vibrate to make a sound, although a sound is made through vibration, the screen needs to be driven by the moving magnetic coil and the piezoelectric ceramic element to vibrate to make a sound, and the vibration is indirect vibration. In this case, weight of the driven screen is relatively high, relatively large driving force is required, and a relatively large amount of power is consumed. This structure cannot be implemented in a headset and a mobile phone with a small battery life. In addition, the screen is fastened all around. Consequently, neither volume nor audio performance of the generated sound can reach a level of a speaker of the electronic apparatus, only an earpiece can be replaced, and the generated sound cannot be used as a speaker sound. In the foregoing electronic device, a light and thin driving diaphragm is used to drive the air in the speaker box to vibrate to make a sound, instead of driving a component with high weight and hardness such as a screen to make a sound. The driving diaphragm is used to directly vibrate the air to make a sound, and no additional driving force is required, so that not only volume and sound effects can be ensured, but also effects of an earpiece and a speaker can be achieved. In addition, an area of the diaphragm can be designed based on internal space of the electronic device, so as to form a large-area vibration to improve volume and sound quality, without consuming relatively large amount of energy.

In a second embodiment of the electronic device shown in the present invention, a difference from the first embodiment lies in that there are a plurality of driving diaphragms, the plurality of driving diaphragms have different areas, and the plurality of driving diaphragms are disposed in parallel at intervals (in sequence) in a same direction. All the driving diaphragms simultaneously vibrate by receiving different audio signals, and drive air in the sub-chambers 111 to vibrate to make sounds in a plurality of different frequency bands, so that the electronic device 100 can implement sound making in all frequency bands. Therefore, a multimodality in each frequency band can be excluded, a distortion effect in each frequency band is reduced, and sound quality of the electronic device 100 is improved. The driving diaphragm in this embodiment is a long strip, and a same direction may be understood as a width direction of the plurality of driving diaphragms. Actually, a plurality of diaphragms in a same speaker box are arranged in sequence on a same plane in the width direction as much as possible, to ensure respective vibration and sound making without wasting space. In this embodiment, the plurality of driving diaphragms are of a same shape without a thickness difference, and an occupied cavity area is reduced. Certainly, there may be a slight difference in shapes of the plurality of driving diaphragms. It should be noted that the thickness of the driving diaphragm in this embodiment may be designed according to an actual application, and is not limited to the cases listed in this embodiment, provided that sound quality can be ensured. In this specification, "a plurality of" means two or more.

Figure 7:
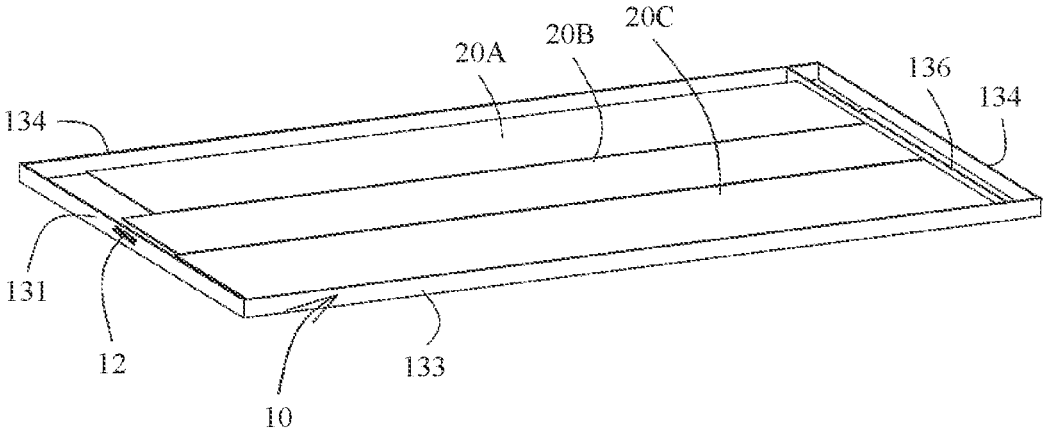
FIG. 7 is a schematic diagram of a second embodiment of the electronic device shown in FIG. 1, where the electronic device includes only a main body and a driving diaphragm.

Next, for ease of understanding, the electronic device 100 shown in this embodiment is described in detail by using an example in which there are three driving diaphragms 20. FIG. 7 is a schematic diagram of assembly of a middle frame and a driving diaphragm of a second embodiment of the electronic device shown m FIG. 1. Different from the embodiment shown in FIG. 2, there are three driving diaphragms. A driving diaphragm 20A, a driving diaphragm 20B, and a driving diaphragm 20C are diaphragms of a same thickness, and driving diaphragms of a same structure, for example, a piezoelectric ceramic element, may be used. The driving diaphragm 20A, the driving diaphragm 20B, and the driving diaphragm 20C have different areas, and simultaneously receive different audio signals to vibrate to make sounds, so that the electronic device 100 makes sounds in all frequency bands. Specifically, the driving diaphragm 20A, the driving diaphragm 20B, and the driving diaphragm 20C are all rectangular diaphragms, and areas decrease sequentially in an arrangement direction. In FIG. 7, areas of the driving diaphragm 20C, the driving diaphragm 20B, and the driving diaphragm 20A decrease sequentially. In this embodiment, the driving diaphragm 20A, the driving diaphragm 20B, and the driving diaphragm 20C are fastened to the speaker box 11 in a same fastening manner, specifically in a cantilever manner used in the foregoing fastening manner of the driving diaphragm. Ends (fastening ends) that are of the driving diaphragm 20A, the driving diaphragm 20B, and the driving diaphragm 20C and that face a same direction are fastened to a same side of the box wall of the speaker box 11, and are specifically fastened to a surface that is of the isolation frame 136 and that is located inside the speaker box 11. Free ends of the driving diaphragm 20A, the driving diaphragm 20B, and the driving diaphragm 20C all face a speaker grille 12 located on the first end frame 131 on the middle frame 13, to improve a sound making effect. The driving diaphragm 20A, the driving diaphragm 20B, and the driving diaphragm 20C make sounds in different frequency bands, and may make sounds in three frequency bands: a high frequency band, a medium frequency band, and a low frequency band. In other words, the three driving diaphragms make sounds in all frequency bands. In the sound-making assembly, the three driving diaphragms separately make sounds, so that a multimodality in each frequency band can be excluded, a distortion effect in each frequency band is reduced, and performance of the electronic device 100 is improved. Certainly, thicknesses of the three driving diaphragms may be the same or may be different. This is not specifically limited. A specific case is determined based on an actual design. In another implementation, the driving diaphragm may also be fastened in the foregoing other fastening manners. The manner in the first embodiment may be used for a structure and a fastening manner of the driving diaphragm and a specific structure of the speaker box. Details are not described herein again.

Figure 8:
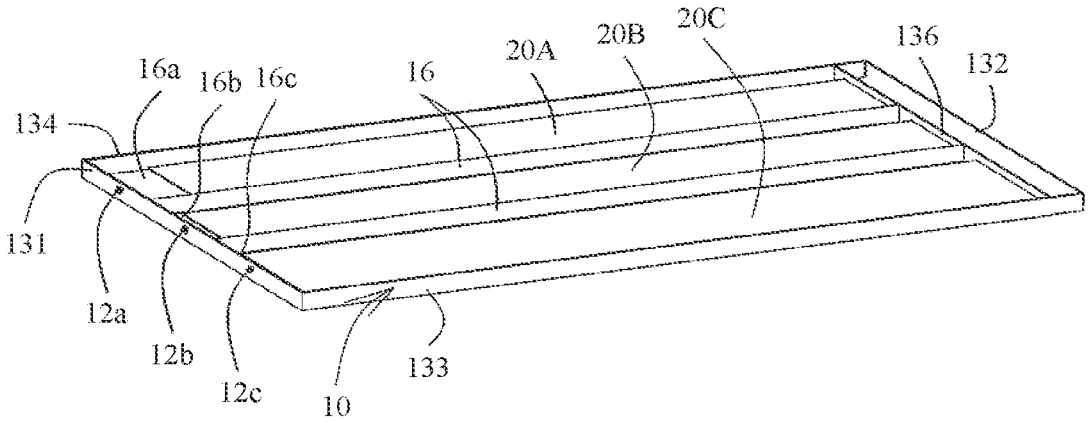
FIG. 8 is a schematic diagram in which a driving diaphragm of the electronic device shown in FIG. 7 is separated by a partition wall.

Further, a partition wall is further disposed between every two adjacent driving diaphragms, the partition wall divides the speaker box into a plurality of independent speaker sub-boxes, and each speaker sub-box is correspondingly provided with one speaker sub-grille. The plurality of speaker sub-boxes extend in a same direction and are disposed in parallel, so that audio in different frequency bands is emitted through the independent speaker sub-boxes. Every two driving diaphragms can be separated, so that when the plurality of driving diaphragms vibrate to make a sound, the plurality of driving diaphragms do not interfere with each other, to ensure volume, and improve sound quality of a sound made by the vibration and sound-making apparatus. Specifically, referring to FIG. 8, based on the embodiment shown in FIG. 7, a partition wall 16 is disposed between the driving diaphragm 20A and the driving diaphragm 20B, and a partition wall 16 is disposed between the driving diaphragm 20B and the driving diaphragm 20C. The two partition walls 16 are disposed in parallel, and opposite ends are connected to the first end frame 131 and the isolation frame 136. The two partition walls 16 divide the speaker box 11 into three independent speaker sub-boxes: a speaker sub-box 16*a*, a speaker sub-box 16*b*, and a speaker sub-box 16*c*, and the speaker sub-box 16*a*, the speaker sub-box 16*b*, and the speaker sub-box 16*c* respectively accommodate the driving diaphragm 20A, the driving diaphragm 20B, and the driving diaphragm 20C. Corresponding to the speaker sub-box 16*a*, the speaker sub-box 16*b*, and the speaker sub-box 16*c*, a speaker grille 12*a*, a speaker grille 12*b*, and a speaker grille 12*c* are respectively disposed on the first end frame 131, and are configured to respectively spread sounds in the speaker box 16*a*, the speaker sub-box 16*b*, and the speaker sub-box 16*c*. A structure and a fastening manner of a driving diaphragm in each speaker sub-box are not limited to the manners shown in this embodiment, and the driving diaphragm may also be fastened in the foregoing several manners. Audio in different frequency bands is emitted through the independent speaker sub-boxes, so that when the plurality of driving diaphragms vibrate to make sounds, the plurality of driving diaphragms do not interfere with each other, to ensure sound quality, and improve sound quality of a sound made by the vibration and sound-making apparatus.

Further, the electronic device 100 further includes a processor (not shown in the figure), and the processor is electrically connected to the driving diaphragm 20A, the driving diaphragm 20B, and the driving diaphragm 20C, separately sends audio signals to the driving diaphragm 20A, the driving diaphragm 20B, and the driving diaphragm 20C, and controls the driving diaphragm 20A, the driving diaphragm 20B, and the driving diaphragm 20C to simultaneously vibrate and work in different frequency bands, so that the electronic device 100 achieves a consistent and flat frequency response in all frequency bands, and improve sound quality. Certainly, in another embodiment, the three driving diaphragms may partially make sounds to meet an audio requirement of a user. In an implementation, each driving diaphragm is equipped with one driver circuit, the processor outputs a plurality of different audio signals to a plurality of driver circuits, and each driver circuit drives a driving diaphragm connected to the driver circuit to vibrate to make a sound. According to this solution, separate control can be implemented and performance of controlling each driving diaphragm is relatively good. In another implementation, the processor sends a same signal to one driver circuit, and the driver circuit separately transmits the same signal to the plurality of driving diaphragms after frequency division. In this manner, there is a simple structure.

With reference to the foregoing two embodiments, in a third embodiment of this embodiment, a difference from the foregoing two embodiments lies in that there are two sound-making assemblies in this embodiment. To be specific, there are two speaker boxes, and the two speaker boxes are separated by a support body disposed on a support plate on a middle frame and each correspond to a speaker grille. That one or more driving diaphragms are disposed in each speaker box may be understood as that two sound-making assemblies are disposed on the electronic device. It should be noted that in this embodiment, structures of the display, the middle frame, the rear housing, and the speaker box of the electronic device, and a quantity, a fastening manner, and a composition structure of the driving diaphragm in the speaker box may be any one of the foregoing implementations. To be specific, the foregoing corresponding embodiments in this specification may be used for disposing and mutual cooperation of the driving diaphragm and the speaker box in this embodiment. Details are not listed herein one by one. In this implementation, the support body is used as a part of box walls of the two speaker boxes and completely separates the two speaker boxes, so that the two speaker boxes make sounds, and the vibration and sound-making apparatus implements stereo sound making.

Further, the speaker grilles corresponding to the two speaker boxes are symmetric about the support body, so that the two speaker grilles evenly spread sounds in the two speaker boxes. In other words, balanced stereo sound making is implemented.

Figure 9A:
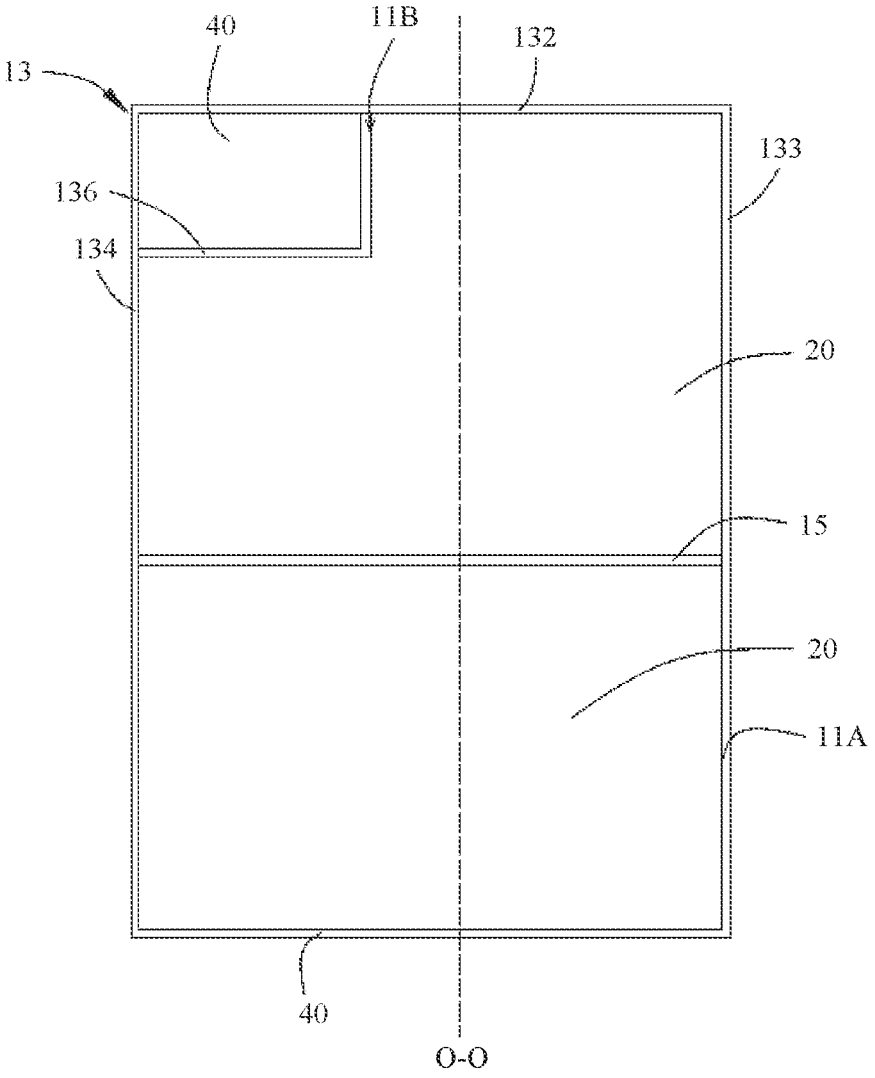
FIG. 9*a* is a schematic structural diagram of a top view of a third embodiment of the electronic device shown in FIG. 1.
Figure 9B:
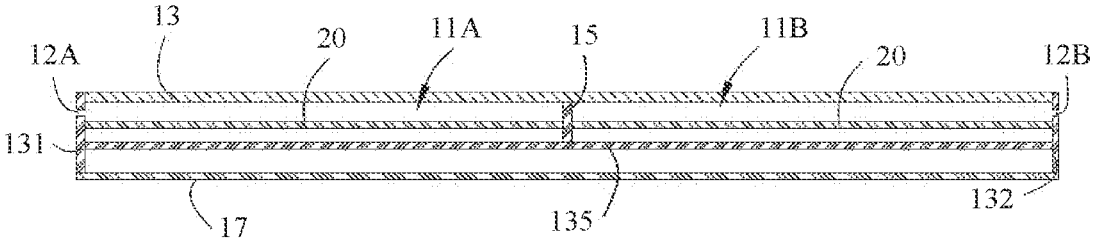
FIG. 9*b* is a schematic diagram of a sectional view along an O-O direction of the electronic device shown in FIG. 9*a;*

The following describes an electronic device having a stereo effect by using specific embodiments. FIG. 9*a* is a schematic of a sectional view of a third embodiment of the electronic device shown in FIG. 1. FIG. 9*b* is a schematic sectional view of FIG. 9*a* along an O-O line, the camera module is not displayed. A support body 15 is disposed on a surface that is of the support plate 135 of the middle frame and that faces the display 30, to form two speaker boxes: a speaker box 11A and a speaker box 11B, and the speaker boxes 11A is correspondingly provided with a speaker grille 12A disposed on the first end frame 131, the speaker box 11B is provided with a speaker grille 12B located on the second end frame 132. The support body 15 completely isolates the speaker box 11A and the speaker box 11B, so that the speaker box 11A and the speaker box 11B independently make sounds, and the vibration and sound-making apparatus implements stereo sound. To be specific, the speaker box 11A, the speaker box 11B, and the internal driving diaphragm 20 respectively make sounds through a left audio channel and a right audio channel, so that the electronic device 100 achieves a dual-channel stereo sound making effect. In addition, the electronic device in this embodiment has a dual-channel stereo function by directly vibrating the driving diaphragm. There is low power consumption and simple structure, and no space is occupied, and this structure is easy to implement. Certainly, the speaker box 11A and the speaker box 11B may work independently. Specifically, the support body 15 supports the display 30 and the support plate 135 of the middle frame 13, and is connected to the first side frame 133 and the second side frame 134. The support body 15 is connected to a surface that is of the support plate 135 and that faces the display and a side that is of the display 30 and that faces the support plate 135. The support body 15 is made of a metal material such as aluminum, and the support body 15 is light and thin and can implement fast heat dissipation of the electronic device 100. The support body 15 may be integrated with the middle frame 13, to ensure a sealing effect, so as to simplify a production and processing process of the electronic device 100, and reduce production costs of the electronic device 100. As shown in FIG. 9*a*, the isolation frame 136 in this embodiment is disposed around the camera module, and the first end frame 131, a part of the first side frame 133, a part of the second side frame 134, and the support body 15 form the speaker box 11A. The isolation frame 136, a part of the first side frame 133, a part of the second side frame 134, and the support body 15 form the speaker box 11B. The camera module 40 is isolated from the speaker box 11B by being surrounded by the isolation frame 136. Certainly, the manner in the first embodiment in which the isolation frame 136 may be connected to the first side frame 133 and the second side frame 134 to isolate the camera module may also be used, to form a speaker box between the isolation frame 136 and the first end frame 131. The speaker box is divided by a support body into two symmetric speaker boxes, and a speaker grille may be disposed on the first side frame 133 or the second side frame 134.

Still referring to FIG. 9*a*, in this embodiment, an example in which a driving diaphragm 20 is fastened in each of the speaker box 11A and the speaker box 11B is used, and any implementation of the driving diaphragm shown in FIG. 5*a*. FIG. 5*b*, and FIG. 5*c* may be used for the driving diaphragm 20. Certainly, the driving diaphragm in FIG. 5*d* may also be used. The driving diaphragm 20 in the speaker box 11A and the driving diaphragm 20 in the speaker box 1B have different areas and shapes, and different audio signals are input to achieve stereo effects. The modulator may be used to optimize and adjust sound quality. In this embodiment, a periphery of the driving diaphragm 20 in the speaker box 11A is fastened in a manner of being connected to a box wall of the speaker box 11A. Specifically, the periphery of the driving diaphragm 20 is connected to the first end frame 131, a part of the first side frame 133, a part of the second side frame 134, and a surface that is of the support body 15 and that are located on the speaker box 11A. A periphery of the driving diaphragm 20 in the speaker box 11B is fastened and connected to a box wall of the speaker box 11B, and is specifically connected to the second end frame 132, a part of the first side frame 133, a part of the isolation frame 136, the second side frame 134, and a surface that is of the support body 15 and that are located on the speaker box 11B. In another implementation, when the driving diaphragms 20 in the speaker box 11A and the speaker box 11B may be fastened in a cantilever manner in the manner of fastening the driving diaphragm 20 in the first embodiment, fastening ends 20*a* of the two driving diaphragms 20 are both fastened to surfaces of the support body 15 that face the speaker box 11A and the speaker box 11B.

Figure 9C:
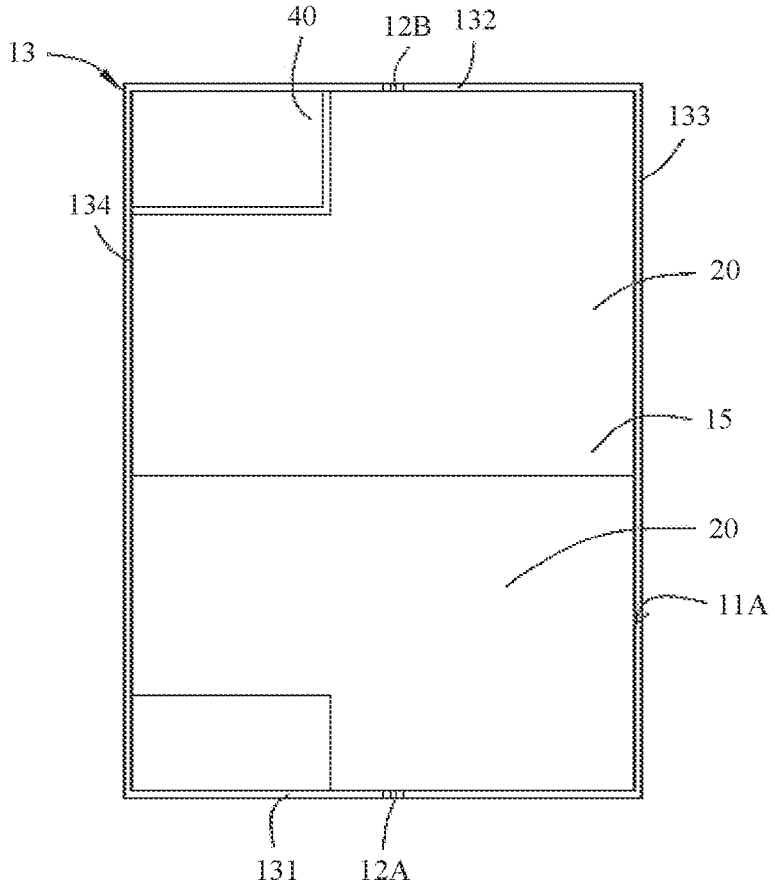
FIG. 9*c* is a top view in which a driving diaphragm of the electronic device shown in FIG. 9*a* is symmetrically disposed.

In a case, the driving diaphragm 20 in the speaker box 11A and the driving diaphragm 20 in the speaker box 11B have a same area and shape, the two speaker boxes are symmetric about the support body, and the driving diaphragms in the two speaker boxes are symmetric about the support body, so that the vibration and sound-making apparatus implements a balanced stereo sound. Specifically, referring to FIG. 9*c*, a difference from the embodiment shown in FIG. 9*a* lies in that the speaker box 11A and the speaker box 11B are symmetric about the support body 15 (which is equivalent to that the two speaker boxes are symmetric by using the support body as a central symmetry line). The driving diaphragms 20 in the speaker box 11A and the speaker box 11B are symmetric about the support body 15 (which is equivalent to that the two driving diaphragms are symmetric in size by using the support body as a central symmetry line), so that the electronic device 100 implements fully balanced stereo sound making, and sound quality is improved. Specifically, the speaker box 11A and the speaker box 11B have equal lengths, widths, and heights, and the driving diaphragms 20 in the speaker box 11A and the speaker box 11B have equal areas and thicknesses, to ensure that the two speaker boxes make a balanced stereo sound, and design difficulty is simplified. In this embodiment, the speaker box 11B avoids the camera module 40 in a manner in which the isolation frame 136 surrounds the camera module. The driving diaphragm 20 is in a non-rectangular structure, and the driving diaphragm 20 in the speaker box 11A may have a same structure as the driving diaphragm 20 in the speaker box 11B. A speaker grille 12A connected to the speaker box 11A is disposed on the first end frame 131, a speaker grille 12B connected to the speaker box 11B is disposed on the second end frame 132, and the speaker box 11B and the speaker box 11A are symmetric about the support body 15. In this way, the two speaker grilles spread sounds in the two speaker boxes in a balanced manner, to further implement balanced sound making of the vibration and sound-making apparatus.

In another implementation, the driving diaphragm 20 in the speaker box 11A and the driving diaphragm 20 in the speaker box 11B have different areas, and the vibration and sound-making apparatus is further connected to a modulator. The modulator adjusts the audio signal, so that the driving diaphragm 20 in the speaker box 11A and the driving diaphragm in the speaker box 11B vibrate in a balanced manner, so as to implement balanced sound making through left and right audio channels. The modulator adjusts, according to a digital signal processing algorithm, audio signals that are input into the driving diaphragms in the two speaker boxes, so that a sound effect is kept balanced when the driving diaphragms in the two speaker boxes vibrate, to implement a balanced stereo sound of the vibration and sound-making apparatus. Alternatively, the two speaker boxes are asymmetric, and the driving diaphragms in the two speaker boxes have a same area or different areas. Alternatively, the modulator may be used to adjust the audio signals, so that the driving diaphragms vibrate in a balanced manner.

In the prior art, a magnetic actuator including a moving magnetic coil, a piezoelectric ceramic element, and the like are connected to a screen to drive the screen to vibrate to make a sound, and a quantity of magnetic actuators needs to be increased to drive a screen with relatively high quality. Consequently, stereo sound sources are separated inevitably unclearly, and even there is no stereo effect. However, in this application, only two independent speaker boxes including driving diaphragms need to be made to form a left audio channel and a right audio channel. In this way, stereo effect can be achieved when the driving diaphragms separately vibrate to make a sound, so that there is a small size and a small loss when sound quality and volume are ensured. In addition, a sound from the left audio channel and a sound from the right audio channel can be balanced.

Figure 10:
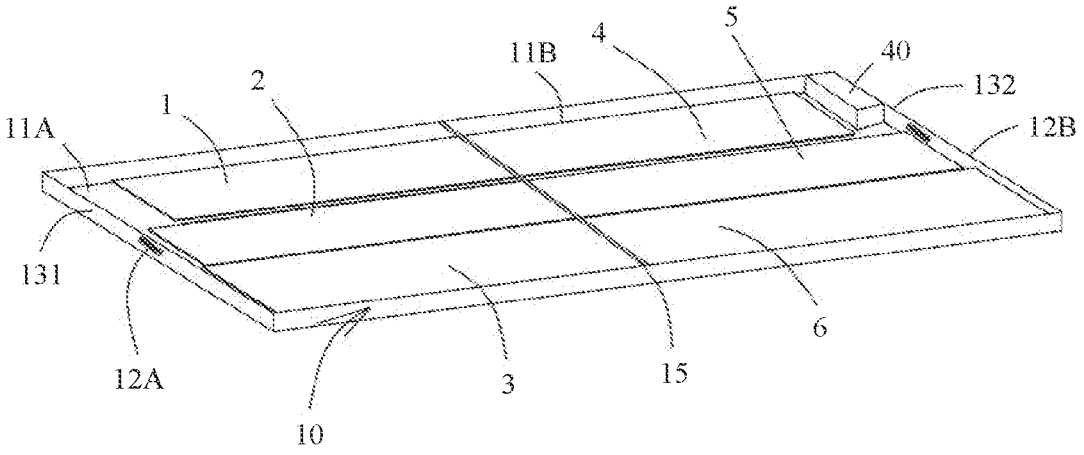
FIG. 10 is a schematic structural diagram of a top view of a fourth embodiment of the electronic device shown in FIG. 1, where a difference from FIG. 9*a* is that there are a plurality of driving diaphragms.

Referring to FIG. 10, in a fourth embodiment of the electronic device in the present invention, a difference from the embodiment in FIG. 9*a* lies in that there are a plurality of driving diaphragms in each of the speaker box 11A and the speaker box 11B, so that sounds are made in all frequency bands in each speaker box and a multimodality in each frequency band in each speaker box is excluded, to reduce a distortion effect in each frequency band. In some specific manners, a cantilever manner in which one end is fastened may be designed for a driving diaphragm in each speaker box. The speaker box 11A includes a driving diaphragm 1, a driving diaphragm 2, and a driving diaphragm 3. The driving diaphragm 1, the driving diaphragm 2, and the driving diaphragm 3 are arranged in sequence and extend in a same direction. The speaker box 11B includes a driving diaphragm 4, a driving diaphragm 5, and a driving diaphragm 6. The driving diaphragm 4, the driving diaphragm 5, and the driving diaphragm 6 are arranged in sequence, and extend in a same direction. In this embodiment, the driving diaphragms in the speaker box 11B avoid a position of the camera module, and a free end of the driving diaphragm 4 with a smallest area faces the position of the camera module 40. Actually, the driving diaphragm may avoid the camera module in any one of the foregoing manners. For example, the camera module is disposed on a surface that is of the support plate 135 and that faces the rear housing 17, a light-through hole is disposed on the support plate 135, and a through hole is disposed on a driving diaphragm corresponding to the light-through hole. This is the same as that in the foregoing related embodiments, and details are not described again.

In a case, a stereo sound is ensured to be balanced in the speaker box 11A and the speaker box 11B. The driving diaphragm 1 and the driving diaphragm 4 are symmetric about the support body 13, the driving diaphragm 2 and the driving diaphragm 5 are symmetric about the support body 13, and the driving diaphragm 3 and the driving diaphragm 6 are symmetric about the support body 13, so that in each speaker box, sounds are made in all frequency bands including a high frequency, a medium frequency, and a low frequency. For the speaker box 11A and the speaker box 11B including a plurality of driving diaphragms, the processor may be electrically connected to the driving diaphragms in the speaker box, to control the plurality of driving diaphragms to simultaneously vibrate and respectively work in different frequency bands, so as to implement a flatness feature of sound effects of the left audio channel and the right audio channel. Certainly, when the speaker box 11A and the speaker box 11B work independently, the processor only needs to drive operating frequency bands of a plurality of driving diaphragms in a same speaker box.

In another implementation, modulators are separately disposed in the speaker box 11A and the speaker box 11B. The driving diaphragm 1, the driving diaphragm 2, and the driving diaphragm 3 in the speaker box 11A have different areas, and the driving diaphragm 4, the driving diaphragm 5, and the driving diaphragm 6 in the speaker box 11B have different areas. Audio signals of the driving diaphragms in the two speaker boxes may be adjusted by using the modulator, to achieve a balance. Certainly, quantities of driving diaphragms in the two speaker boxes may be different, and the two speaker boxes and the driving diaphragms may not be symmetric about the support body, provided that sound quality of each speaker box can be ensured and overall stereo sound making and sound quality can be implemented. Examples are not listed one by one herein.

In some embodiments, there are three or more speaker boxes in the electronic device, every two speaker boxes may be disposed in a stacked manner or may be disposed in parallel, and each speaker box corresponds to a speaker grille, so that the three or more speaker boxes simultaneously make sounds in a plurality of different frequency bands, to implement multichannel sound making. In this way, a quantity of dimensions in which the electronic device makes a sound is increased, a stereognostic sense of a sound is improved, and user experience is improved.

In some embodiments, the electronic device includes a waterproof valve and a valve controller, which are not shown in the figure. The waterproof valve is disposed on a side of the speaker grille, and the valve controller controls, based on a humidity value of the speaker grille, the waterproof valve to close or open the speaker grille, to prevent external moisture from entering the speaker box and causing damage to the electronic device. The valve controller includes a control module and a humidity detection module. The humidity detection module is configured to feed back the humidity value of the speaker grille. The control module is electrically connected to the humidity detection module. The control module determines the humidity value of the speaker grille based on the humidity value that is of the speaker grille and that is fed back by the humidity detection module, and controls, based on a determining result, the waterproof valve to close or open the speaker grille, so as to implement intelligent protection for the electronic device.

Figure 11:
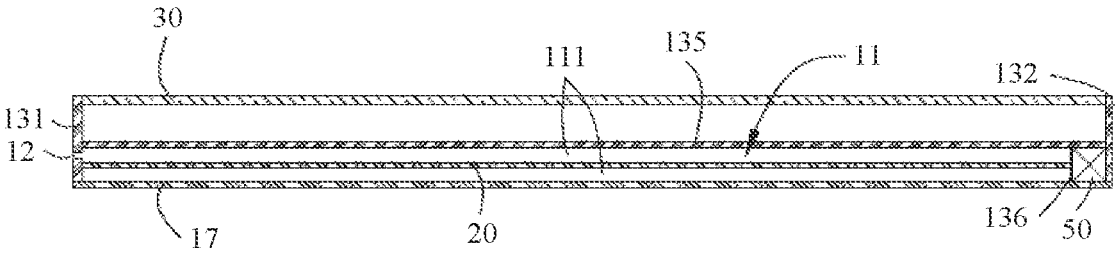
FIG. 11 is a schematic diagram of a sectional view of a fifth embodiment of the electronic device shown in FIG. 1, where a speaker box and a driving diaphragm are located between a support plate of a middle frame and a rear housing.

FIG. 11 is a schematic diagram of a sectional view of a fifth embodiment of an electronic device according to the present invention. A difference from the foregoing embodiments is that the speaker box 11 is located between the middle frame 13 and the rear housing 17, and a side frame of the middle frame surrounds a gap between the support plate 135 of the middle frame 13 and the rear housing 17 to form the speaker box 11. A manner of isolating the camera module 50 of the electronic device from the driving diaphragm or the speaker box is the same as the manner listed in Embodiment 1. In this embodiment, the isolation frame 136 is disposed on a surface that is of the support plate 135 and that faces the rear housing 17, and is connected to the rear housing 17, the first side frame 133, and the second side frame 134. The first end frame 131, the first side frame 133, the second side frame 134, and the isolation frame 136 surround the gap between the support plate 135 and the rear housing 17, to specifically form the speaker 11. The speaker grille 12 is disposed on the first end frame 131, and all gaps other than the speaker grille 12 are sealed. In this embodiment, one speaker box 11 and one driving diaphragm 20 are used as an example for description. Other implementations of a structure of a driving diaphragm, a fastening manner, a quantity of speaker boxes, and composition of the speaker box in any one of the foregoing embodiments are also applicable to this embodiment. Examples are not listed one by one herein. In comparison with the prior art in which most components of the electronic device are placed between the middle frame and the screen, in the electronic device in this embodiment, the speaker box and the driving diaphragm are disposed between the middle frame and the rear housing, so that mutual interference in a position between the driving diaphragm 20 and other components can be reduced.

Figure 12:
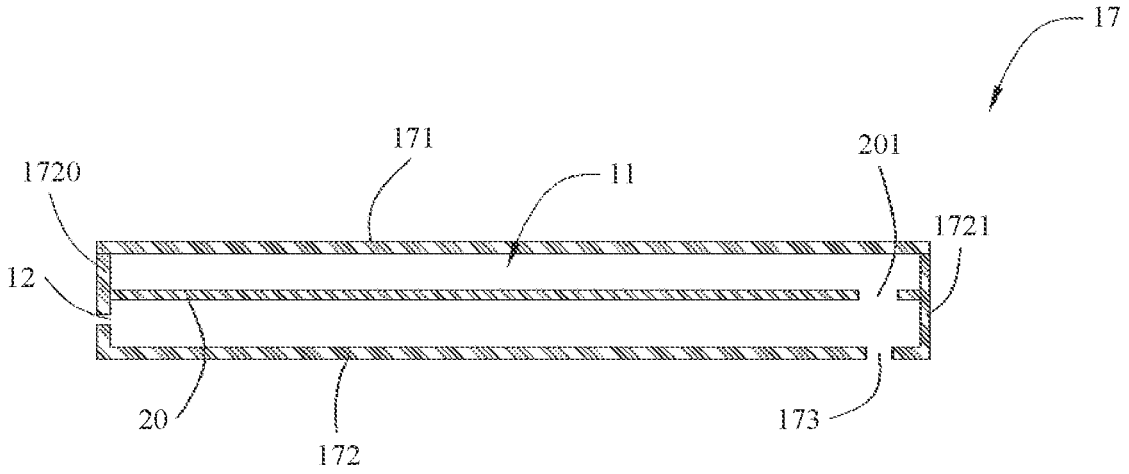
FIG. 12 is a schematic diagram of a sectional view of a sixth embodiment of the electronic device shown in FIG. 1, where a speaker box and a driving diaphragm are located inside a rear housing.

Referring to FIG. 12, in a sixth embodiment of an electronic device according to the present invention, a difference from the first embodiment lies in that the speaker box 11 is disposed in the rear housing 17 and an isolation frame 136 does not need to be disposed on the middle frame. The speaker grille 12 is disposed in any position of the rear housing 17, provided that vibration and sound quality are not affected. Specifically, the rear housing 17 includes a first housing 171 and a second housing 172. The first housing 171 and the second housing 172 are snap-fitted to form the speaker box 11. In this embodiment, an opening 201 is disposed in a position that is on the driving diaphragm 20 and that corresponds to a view window 173, so as to be used by the camera module to collect light. In this implementation, the speaker box is directly formed inside the rear housing 17, so that a structure is simpler and is easy to implement. In addition, the speaker grille may be disposed in a peripheral wall 1720 or a rear wall 1721 of the second housing 172, to increase volume. In this embodiment, one speaker box 11 and one driving diaphragm 20 are used as an example for description. The structure of the driving diaphragm, the fastening manner, the quantity of speaker boxes, the composition of the speaker box, and the like in the first to the fourth embodiments are also applicable to this embodiment. Examples are not listed one by one herein.

In some embodiments, the electronic device includes a processor (not shown in the figure). The processor may be directly disposed on a circuit board of the electronic device, and is configured to: be electrically connected to a plurality of driving diaphragms in a same speaker box, send audio signals to the plurality of driving diaphragms, and control the plurality of driving diaphragms to respectively work in different frequency bands. In this way, the plurality of driving diaphragms vibrate and drive air in the speaker box to vibrate, to make sounds in a plurality of different frequency bands, so that the electronic device can achieve a consistent and flat frequency response in all frequency bands.

In comparison with an existing device in which a common speaker, a micro-magnetic speaker, and a micro-vibration motor are used, in the electronic device in this embodiment, a speaker box is formed by using a structure of the electronic device, and directly forms a speaker in cooperation with the driving diaphragm, to implement vibration and sound making by vibrating air in the speaker box. In this way, a thickness and a size can be greatly reduced, a light and thin design is implemented, and the driving diaphragm can be disposed in a large area, so that volume and sound quality can be improved, a structure is simple, and practicability is strong. However, for an electronic device in the prior art in which a moving magnetic coil and a piezoelectric ceramic element are connected to a screen to drive the screen to vibrate to make a sound, relatively large driving force is required, only an earpiece can be replaced, and the generated sound cannot be used as a speaker sound. To overcome this disadvantage, in the electronic apparatus, a light and thin driving diaphragm is used to drive the air in the speaker box to vibrate to make a sound, instead of driving a component with high quality and hardness such as a screen to make a sound. The electronic apparatus vibrates air to make a sound, and does not need additional driving force. In this way, not only volume and a sound effect in a speaker mode are ensured and effects of the earpiece and the speaker are achieved, but also energy can be saved.

In some embodiments, the vibration and sound-making apparatus is an independent sound-making component, and may be directly disposed inside the electronic device and used as a sound-making component. This structure is simple and easy to install, and volume and sound quality can be ensured. In other words, a difference between the vibration and sound-making apparatus in this embodiment and the foregoing embodiment of the electronic device is that the speaker box and the driving diaphragm are disposed in a box, and the box is provided with a speaker grille. It may also be understood as that a speaker box of a sound-making assembly is disposed in the box, and a specific quantity of speaker boxes, a form of a driving diaphragm, a fastening manner of the driving diaphragm, and a quantity of driving diaphragms may all be designed according to any one of the foregoing embodiments, without a need to avoid a position of the camera module. The vibration and sound-making apparatus in this embodiment may be directly applied to a mobile phone, a notebook computer display, a tablet, a personal digital assistant, a portable multimedia player, a navigation device, a smartwatch, an earphone, and an electronic device that needs to make a sound, such as a digital television display or a desktop computer. For example, a gap is reserved, without affecting arrangement of other components, between the middle frame and a surface that is of the display and that faces the main body, to accommodate the vibration and sound-making apparatus. The vibration and sound-making apparatus occupies relatively regular space, so that assembly is convenient, and internal design difficulty of the electronic device is not increased. The driving diaphragm can be powered by using the mobile phone. For example, in a specific manner, a lead of a circuit board is connected to an electrode on the driving diaphragm.

To better understand the vibration and sound-making apparatus used as an independent component in this embodiment, the following uses a specific embodiment for detailed description.

Figure 13:
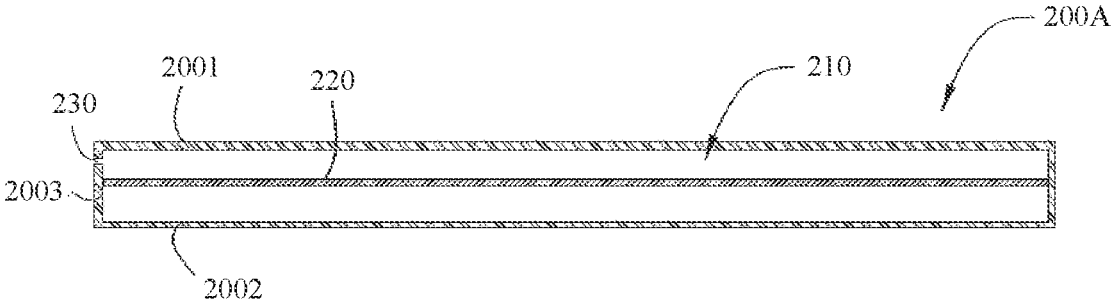
FIG. 13 is a schematic diagram of a sectional view of a first embodiment of a vibration and sound-making apparatus according to an embodiment.

For a first embodiment of a vibration and sound-making apparatus in the present invention, refer to FIG. 13. The vibration and sound-making apparatus includes a case 200A and a driving diaphragm 220. A speaker box 210 is disposed inside the case 200A and the case 200A is provided with a speaker grille 230 corresponding to the speaker box 210, the driving diaphragm 220 is fastened inside the speaker box 210 and divides the speaker box 210 into two sub-chambers, the speaker grille 230 is connected to one sub-chamber, the driving diaphragm 220 vibrates after receiving an audio signal, the driving diaphragm 220 drives, through vibration of the driving diaphragm 220, air in the two sub-chambers to vibrate to make a sound, and the sound is spread through the speaker grille 230. In this embodiment, there is one speaker box 210 and one driving diaphragm 220. The case 200 includes a top cover 2001, a bottom cover 2002, and a side frame 2003. The top cover 2001 and the bottom cover 2002 are disposed opposite to each other, the side frame 2003 is connected between the top cover 2001 and the bottom cover 2002, and the top cover 2001, the bottom cover 2002, and the side frame 2003 are disposed around to form the speaker box 210. It may be understood that a sub-chamber connected to the speaker grille 230 is the front chamber of the sound-making apparatus, and the other sub-chamber is a back chamber. The speaker grille 230 is formed by arranging a plurality of tiny holes at intervals, and is specifically disposed on an end of the side frame 2003, so that the case 200A matches a large display device such as a mobile phone, to connect the speaker box 210 and an external environment, and transmit a sound generated in the speaker box 210 to the external environment.

In this embodiment, the case 200A is a square body, and the speaker box 210 is a three-dimensional square space. In other implementations, shapes of the case, the speaker box, and the driving diaphragm may be other shapes, provided that the shapes are applicable to a shape and internal space of an electronic device in the prior art. The case 200A is made of a light and thin material, to ensure that the vibration and sound-making apparatus has a relatively thin size and does not affect vibration and sound-making. Certainly, the case 200A may also be made of another material, provided that sound quality and audio emitted through vibration is not affected. Specifically, the case 200A is made of aluminum alloy, to not only effectively dissipate heat for the vibration and sound-making apparatus, but also reduce a size of the vibration and sound-making apparatus. The side frame 2003 may be made of a material that is more conducive to vibration and sound making of the driving diaphragm 220. Both areas of the driving diaphragm 220 and the case 200A may be set based on an actual area of an electronic device such as a headset, a mobile terminal, or a television display, provided that the case 200A can accommodate the driving diaphragm 220 and it is ensured that the driving diaphragm 220 can vibrate to make a sound. The case 200A can be disposed only by using a gap in the electronic device, and is different from an existing speaker, or the like that has a complex speaker structure, that is combined with the electronic device with a greater difficulty, and that occupies large thickness space. Therefore, a design difficulty and a size can be greatly reduced, and a size of the electronic device can be further reduced. It may be understood that, if the case is made of a material that affects the antenna of the electronic device and is relatively close to the antenna, the case may be shielded by using a shielding structure, which is determined based on an actual design case.

The driving diaphragm 220 is of a rectangular film structure, and may be a diaphragm in any form in the foregoing embodiment, and a fastening manner is selected based on different structures of the driving diaphragm. The driving diaphragm in this embodiment is of a piezoelectric ceramic element structure, and a periphery of the driving diaphragm 220 is fastened to a surface that is of the frame 2003 and that is located inside the speaker box 210, namely, a box wall of the speaker box 210. In a thickness direction of the driving diaphragm 220, a thickness of the speaker box 210 is between 0.05 mm and 0.5 mm. Sufficient vibration space is provided for a vibration amplitude to be achieved by the driving diaphragm 220. The driving diaphragm 220 is approximately parallel to the top cover 2001 and the bottom cover 2002, to ensure uniformity of air driven during vibration. In this specification, fastening the driving diaphragm and the speaker box means that the driving diaphragm is fastened to a side frame, and the driving diaphragm is parallel to the top cover and the bottom cover, so that vibration and sound making can be implemented in an area that is large enough. Certainly, if necessary, the driving diaphragm may also be disposed in another position inside the speaker box. It may be understood that, in another embodiment, there may be an included angle between the driving diaphragm 20 and each of the top cover and the bottom cover. Actually, provided that volume and sound quality of a sound made by the vibration and sound-making apparatus are not affected, whether the two oppositely disposed surfaces of the driving diaphragm are absolutely parallel, and whether there is an included angle between the driving diaphragm and each of the top cover and the bottom cover are both acceptable for the vibration and sound-making apparatus in this application. In this embodiment, there may be a plurality of driving diaphragms. The plurality of driving diaphragms have different areas, and simultaneously receive different audio signals to vibrate to make sounds, so that sounds are made in all frequency bands.

A difference between another embodiment of this embodiment and the foregoing embodiment is that two speaker boxes are disposed inside the case 200A of the vibration and sound-making apparatus, the two speaker boxes are separated by a support body and each correspond a speaker grille. The support body completely isolates the two speaker boxes, so that the two speaker boxes make sounds, and the vibration and sound-making apparatus implement stereo sound making. Further, the speaker grilles corresponding to the two speaker boxes are symmetric about the support body, so that the two speaker grilles evenly spread sounds in the two speaker boxes.

Figure 14:
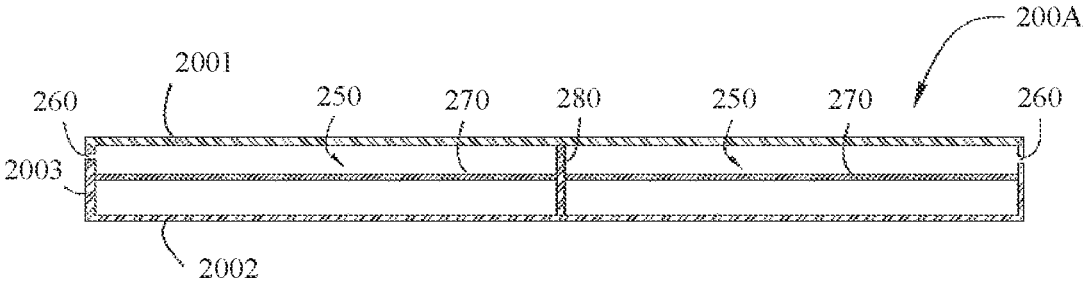
FIG. 14 is a schematic diagram of a sectional view of a second embodiment of a vibration and sound-making apparatus according to an embodiment.

Specifically, referring to FIG. 14, the vibration and sound-making apparatus in this embodiment includes two speaker boxes 250 that are separated by a support body 280. The support body 280 provides a support between the top cover 2001 and the bottom cover 2002, and completely separates the two speaker boxes 250, so that the speaker boxes 250 independently make sounds, and the vibration and sound-making apparatus implements stereo sound making. One driving diaphragm 270 is disposed in each speaker box 250. Each speaker box corresponds to one speaker grille 260, and the speaker grille 260 is disposed on the frame 2003. The vibration and sound-making apparatus achieves a dual-channel sound making effect, a structure is simple, and space is saved. The vibration and sound-making apparatus is easy to implement. In this embodiment, for example, one driving diaphragm 20 is fastened inside each of the two speaker boxes 250. The driving diaphragms 270 in the two speaker boxes 250 have a same area and a same shape, and different audio signals are input. In this embodiment, peripheries of the driving diaphragms in the two speaker boxes 250 are fastened and connected to a box wall of the speaker box 250.

In a case, the two speaker boxes are symmetric about the support body, and the driving diaphragms in the two speaker boxes are symmetric about the support body, so that the vibration and sound-making apparatus implements a balanced stereo sound. In this embodiment, two speaker boxes 250 are symmetric about the support body 280 (which is equivalent to that the two speaker boxes are symmetric by using the support body as a central symmetry line). The driving diaphragms 270 in the two speaker boxes 250 are symmetric about the support body 280 (which is equivalent to that the two driving diaphragms are symmetric by using the support body as a central symmetry line), so that the vibration and sound-making apparatus implements fully balanced stereo sound making, and sound quality of the vibration and sound-making apparatus is improved. Specifically, the two speaker boxes have equal lengths, widths, and heights, and the driving diaphragms 270 in the two speaker boxes 250 have equal areas and thicknesses, to ensure that the two speaker boxes make a balanced stereo sound, and design difficulty is simplified. In this embodiment, the speaker grilles 260 connected to the two speaker boxes 250 are symmetric about the support body 280, so that the two speaker grilles evenly spread sounds in the two speaker boxes, to further implement balanced sound making of the vibration and sound-making apparatus. Certainly, the speaker grille may also be disposed in another position.

In another implementation, the driving diaphragms 270 in the two speaker boxes 250 have different areas, and the vibration and sound-making apparatus is further connected to a modulator. The modulator adjusts an audio signal, so that the driving diaphragms in the speaker boxes vibrate in a balanced manner, so as to implement balanced sound making through left and right audio channels. The modulator adjusts, according to a digital signal processing algorithm, audio signals that are input into the driving diaphragms in the two speaker boxes, so that a sound effect is kept balanced when the driving diaphragms in the two speaker boxes vibrate, to implement a balanced stereo sound of the vibration and sound-making apparatus. Alternatively, the two speaker boxes are asymmetric, and the driving diaphragms in the two speaker boxes have a same area or different areas. Alternatively, the modulator may be used to adjust the audio signals, so that the driving diaphragms vibrate in a balanced manner. The regulator may be disposed on a case, or may be disposed on a circuit board of an electronic device in which the vibration and sound-making apparatus is used.

Figure 15:
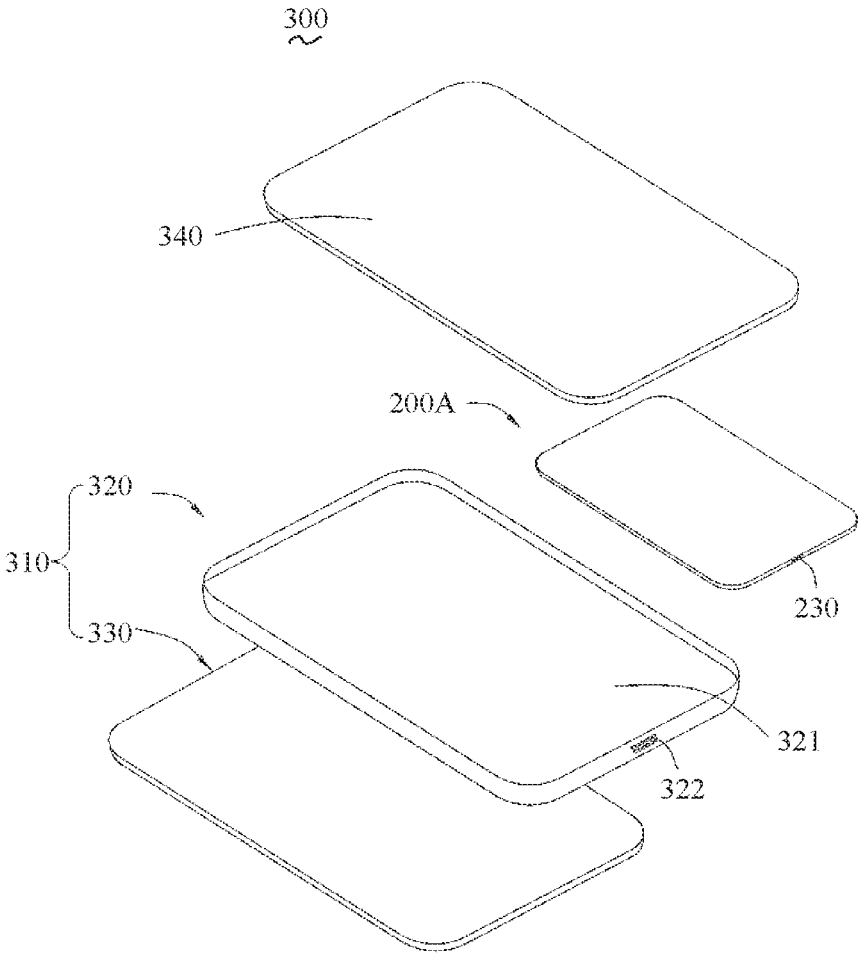
FIG. 15 is a schematic exploded view of a seventh embodiment of an electronic device according to an embodiment.

Referring to FIG. 15, in a seventh embodiment of an electronic device in the present invention, the vibration and sound-making apparatuses 200A listed in the embodiments shown in FIG. 13 and FIG. 14 may be applied. The electronic device 300 includes a main body 310 and a display 340. The main body is provided with a through hole 322 corresponding to a speaker grille 230. The vibration and sound-making apparatus 200A is disposed inside the main body 310, and is configured to implement sound making of the electronic device. Specifically, the main body 310 includes a middle frame 320 provided with a support body 321 and a rear housing 330 disposed on the middle frame. The display 340 is disposed on the middle frame 320, and the display 340 and the rear housing 330 are located on two sides of the support body 321. The vibration and sound-making apparatus 200A is disposed in a gap between the support body 321 and the rear housing 330, or the vibration and sound-making apparatus 200A is disposed in a gap between the support body 321 and the display 340. Actually, a difference between the electronic device in this embodiment and the electronic device 100 shown in FIG. 1 lies in that the electronic device 300 in this embodiment does not have a speaker box and a driving diaphragm, and instead, the vibration and sound-making apparatus 200A used as an independent component is directly disposed inside the main body 310. It is understood that a case in which a driving diaphragm is disposed is disposed in the electronic device 300.

Further, when there are two vibration and sound-making apparatuses 200A, a modulator is disposed inside the electronic device 300. The modulator adjusts an audio signal, so that driving diaphragms in two speaker boxes maintain balanced vibration and sound-making.

The vibration and sound-making apparatus in this embodiment is applied to the electronic device, has a simple structure, and is easy to implement. In addition, instead of driving an element with high quality and hardness such as a screen to make a sound, the driving diaphragm of the vibration and sound-making apparatus vibrates air to make a sound, without needing additional driving force. Therefore, volume and a sound effect can be ensured, an effect of the earpiece and the speaker sound is achieved. In addition, an area of a diaphragm may be designed based on effective space (a distance away from a component such as a camera) in the electronic device, to vibrate in a large area and improve volume and sound quality. This helps design the electronic device, without a need to consume relatively large energy.

The disclosed above is merely example embodiments, and certainly is not intended to limit the protection scope. A person of ordinary skill in the art may understand that all or some of processes that implement the foregoing embodiments and equivalent modifications made in accordance with the claims shall fall within the scope.

What is claimed is:

1. An electronic device comprising:
a main body comprising:
a first speaker grille; and
a middle frame of the main body, wherein the middle frame comprises:
sides of the main body; and
a support plate surrounded by and coupled to the sides;
a display disposed on the main body; and
a sound-making assembly comprising:
a speaker box that is formed using the middle frame of the main body, and wherein the speaker box is further formed using at least one of the support plate, a rear of the main body, and the display, wherein the first speaker grille corresponds to the speaker box; and
a first driving diaphragm located in the speaker box, fastened inside the box, and dividing the speaker box into two sub-chambers,
wherein the first speaker grille is coupled to one of the two sub-chambers, and
wherein the first driving diaphragm is configured to:
receive an audio signal; and
vibrate, based on the audio signal, the first driving diaphragm to drive air in the two sub-chambers to vibrate to make a first sound that propagates through the first speaker grille.

2. The electronic device of claim 1, wherein the sound-making assembly further comprises a plurality of second driving diaphragms disposed in parallel at intervals in a same direction, and wherein the second driving diaphragms are configured to:
receive different audio signals; and
vibrate, based on the different audio signals, the second driving diaphragms to drive the air to vibrate to make second sounds in a plurality of different frequency bands.

3. The electronic device of claim 2, further comprising a partition wall disposed between every two adjacent driving diaphragms, wherein the partition wall divides the speaker box into a plurality of independent speaker sub-boxes, and wherein each of the independent speaker sub-boxes comprises a speaker sub-grille.

4. The electronic device according to claim 1, further comprising two sound-making assemblies comprising:
two speaker boxes arranged in a length direction of the electronic device, wherein the two speaker boxes are separated by a support body, and wherein the two speaker boxes comprise second speaker grilles; and
second driving diaphragms that are configured to simultaneously vibrate to make second sounds to enable the electronic device to implement stereo sound making.

5. The electronic device of claim 4, wherein the second speaker grilles are symmetric about the support body.

6. The electronic device of claim 1, wherein the speaker box comprises a box surface, wherein the electronic device further comprises a protective film stacked on the box surface, and wherein the first speaker grille penetrates the protective film.

7. The electronic device of claim 1, wherein the first driving diaphragm is a piezoelectric ceramic element.

8. The electronic device of claim 1, wherein the first driving diaphragm comprises:
a diaphragm; and
a piezoelectric ceramic element configured to drive the diaphragm to vibrate,
wherein the piezoelectric element is disposed on a surface of the diaphragm or the diaphragm is disposed around a first periphery of the piezoelectric ceramic element.

9. The electronic device of claim 8, wherein the first driving diaphragm further comprises an edge disposed around a second periphery of the diaphragm, and wherein the diaphragm is configured to drive the edge to vibrate.

10. The electronic device of claim 1, wherein the first driving diaphragm comprises a plurality of piezoelectric ceramic elements disposed in a stacked manner.

11. The electronic device of claim 1, further comprising a component cooperating with the display, wherein the main body further comprises a rear housing, wherein the rear housing and the display are fastened on two opposite sides of the middle frame, wherein the support plate and each of the rear housing and the display are disposed at an interval in a stacked manner, wherein the component is convexly disposed on the support plate and is isolated from the speaker box, and wherein the speaker box is:

located between the display and the support plate and is enclosed by the middle frame and the display;

located between the rear housing and the support plate and is enclosed by the middle frame and the rear housing; or disposed inside the rear housing.

12. The electronic device of claim 11, wherein the middle frame further comprises:

a first end frame;

a second end frame disposed opposite to the first end frame;

a first side frame coupled to the first end frame and the second end frame; and a second side frame disposed opposite to the first side frame and coupled to the first end frame and the second end frame, wherein the first end frame, the second end frame, the first side frame, and the second side frame are coupled around the support plate, wherein the support plate comprises an isolation frame disposed on the support plate, and wherein the isolation frame is used as a partial box wall of the speaker box and isolates the component from the first driving diaphragm.

13. The electronic device of claim 11, wherein the component is a front-facing camera system, wherein the front-facing camera system is located on a first side of the support plate that is away from the display, wherein the middle frame further comprises:

a first end frame;

a second end frame disposed opposite to the first end frame;

a first side frame coupled to the first end frame and the second end frame; and a second side frame disposed opposite to the first side frame and coupled to the first end frame and the second end frame, wherein the first end frame, the second end frame, the first side frame, and the second side frame are coupled around the support plate, wherein the support plate comprises a light-through hole disposed opposite to the front-facing camera system, and wherein the first driving diaphragm comprises a through hole corresponding to the light-through hole.

14. The electronic device of claim 11, wherein the rear housing comprises a first housing and a second housing that are snap-fitted to form the speaker box.

15. A vibration and sound-making apparatus comprising:

a case comprising:

a first speaker grille;

a middle frame of the main body, wherein the middle frame comprises:

sides of the main body; and a support plate surrounded by and coupled to the sides;

a speaker box disposed inside the case, wherein the speaker box is formed using the middle frame of the main body, wherein the speaker box is further formed using at least one of the support plate and a rear of the case, and wherein the first speaker grille corresponds to the speaker box;

a first driving diaphragm fastened inside the speaker box and dividing the speaker box into two sub-chambers, wherein the first speaker grille is coupled to one of the two sub-chambers, and wherein the first driving diaphragm is configured to:

receive an audio signal; and vibrate, based on the audio signal, the first driving diaphragm to drive air in the two sub-chambers to vibrate to make a first sound that propagates through the first speaker grille.

16. The vibration and sound-making apparatus of claim 15, further comprising a plurality of second driving diaphragms disposed in parallel at intervals in a same direction, and wherein the second driving diaphragms are configured to:

receive different audio signals; and vibrate, based on the different audio signals, the second driving diaphragms to drive the air to vibrate to make second sounds in a plurality of different frequency bands.

17. The vibration and sound-making apparatus of claim 16, further comprising a partition wall disposed between every two adjacent driving diaphragms, wherein the partition wall divides the speaker box into a plurality of independent speaker sub-boxes, and wherein each of the independent speaker sub-boxes comprises a speaker sub-grille.

18. The vibration and sound-making apparatus of claim 15, further comprising two speaker boxes disposed inside the case and comprise two second diaphragms, wherein the two speaker boxes are arranged in sequence in a length direction of the case and are separated by a support body, and wherein the two speaker boxes comprise:

second speaker grilles; and second driving diaphragms that simultaneously vibrate to make second sounds to enable the vibration and sound-making apparatus to implement stereo sound making.

19. The vibration and sound-making apparatus of claim 18, wherein the two speaker boxes are symmetric about the support body, wherein the second driving diaphragms are symmetric about the support body, and wherein the second speaker grilles are symmetric about the support body.

20. The vibration and sound-making apparatus of claim 16, further comprising a processor electrically coupled to the second driving diaphragms and is configured to:

send the different audio signals to the second driving diaphragms; and control the second driving diaphragms to respectively work in the different frequency bands.

* * * * *